US007677855B2

(12) United States Patent
Parker et al.

(10) Patent No.: US 7,677,855 B2
(45) Date of Patent: Mar. 16, 2010

(54) CONDITIONED SHEETS FOR BINDING AND METHOD/APPARATUS FOR MAKING SAME

(75) Inventors: Kevin P. Parker, Berkeley, CA (US); Eugene E. Anderson, Berkeley, CA (US); Harold P. Hocking, Manhattan Beach, CA (US); Donald J. Brown, Castro Valley, CA (US)

(73) Assignee: Powis Parker, Inc., Berkeley, CA (US)

( * ) Notice: Subject to any disclaimer, the term of this patent is extended or adjusted under 35 U.S.C. 154(b) by 977 days.

(21) Appl. No.: 11/219,342

(22) Filed: Sep. 2, 2005

(65) Prior Publication Data

US 2007/0086875 A1 Apr. 19, 2007

(51) Int. Cl.

| | |
|---|---|
| ***B42C 9/00*** | (2006.01) |
| ***B42B 9/00*** | (2006.01) |
| ***B42B 5/00*** | (2006.01) |
| ***B26D 3/00*** | (2006.01) |
| ***B26F 1/18*** | (2006.01) |

(52) U.S. Cl. ..... 412/6; 412/16; 412/33; 412/8; 83/870

(58) Field of Classification Search ..... 412/15, 412/16, 26, 28–30, 33; 83/19, 870–874, 83/917; 225/2–4; 162/111, 117, 194, 202, 162/205; 100/39; 493/367, 369
See application file for complete search history.

(56) References Cited

U.S. PATENT DOCUMENTS

| | | | | |
|---|---|---|---|---|
| 1,642,866 A | | 9/1927 | Ackley | 144/136.1 |
| 1,747,581 A | * | 2/1930 | Frazier | 412/37 |
| 2,646,726 A | | 7/1953 | Fogg | 409/185 |
| 4,182,186 A | | 1/1980 | Hirsch | 83/467 R |
| 4,484,850 A | * | 11/1984 | Shimizu | 412/11 |
| 4,717,236 A | | 1/1988 | Dewing | 385/109 |
| 5,044,857 A | | 9/1991 | Crudo | 412/19 |
| 5,108,244 A | * | 4/1992 | Bellanca | 412/37 |
| 5,383,755 A | | 1/1995 | Hässig et al. | 412/16 |
| 5,961,268 A | | 10/1999 | Jäger | 412/1 |
| 6,012,890 A | | 1/2000 | Celorio Garrido | 412/19 |

(Continued)

FOREIGN PATENT DOCUMENTS

| | | | |
|---|---|---|---|
| CA | 991219 | 6/1976 | 281/6 |

OTHER PUBLICATIONS

PCT Publication No. WO 99/39917, Publication Date Aug. 12, 1999.

(Continued)

*Primary Examiner*—Dana Ross
*Assistant Examiner*—Kyle Grabowski
(74) *Attorney, Agent, or Firm*—Girard & Equitz LLP

(57) ABSTRACT

Apparatus and method of increasing adhesion of thermal binder strips to coated papers by conditioning an edge of the sheet by splitting the edge which results in an expansion of the edge followed by compressing the edge so as to reduce or eliminate the expansion. In the case of a stack of sheets, the edge of the stack is conditioned by piercing the edge of the stack and in the case of an individual sheet, the conditioning is carried out by splitting at least a portion of the edge of the sheet.

2 Claims, 20 Drawing Sheets

U.S. PATENT DOCUMENTS

| | | | | |
|---|---|---|---|---|
| 6,206,358 | B1 * | 3/2001 | Yamaguchi et al. | 270/52.02 |
| 6,213,456 | B1 * | 4/2001 | Hirano et al. | 270/58.08 |
| 6,213,703 | B1 | 4/2001 | Celorio Garrido | 412/19 |
| 6,443,682 | B2 * | 9/2002 | Marsh | 412/16 |
| 6,641,345 | B2 * | 11/2003 | Cobene et al. | 412/1 |
| 6,966,553 | B2 * | 11/2005 | Rathert | 270/52.18 |
| 7,360,757 | B2 * | 4/2008 | Parker et al. | 270/58.07 |
| 2001/0010793 | A1 * | 8/2001 | Marsh | 412/16 |
| 2002/0064436 | A1 * | 5/2002 | Marsh | 412/1 |
| 2002/0182033 | A1 * | 12/2002 | Weiss | 412/1 |
| 2003/0185654 | A1 * | 10/2003 | Rathert | 412/37 |
| 2005/0152771 | A1 * | 7/2005 | Huotari et al. | 412/8 |
| 2005/0173856 | A1 | 8/2005 | Parker et al. | |
| 2005/0244252 | A1 * | 11/2005 | Hoarau | 412/1 |
| 2006/0067808 | A1 * | 3/2006 | Hoarau | 412/8 |

OTHER PUBLICATIONS

InstaBook, "*Book on Demand Binding*", 1 page, downloaded from the Internet on Feb. 10, 2004 from http://www.instabook.net/binding.html.

* cited by examiner

CONDITIONED SHEETS FOR BINDING AND METHOD/APPARATUS FOR MAKING SAME

BACKGROUND OF THE INVENTION

1. Field of the Invention

The present invention relates generally to the field of bookbinding and in particular to sheets which have been conditioned to enhance binding using thermal adhesive binder strips.

2. Description of Related Art

Bookbinding apparatus have been developed which permits stacks of sheets to be bound using thermally activated adhesive binder strips. Such binder strips are typically applied using relatively low cost desktop binding machines such as disclosed in U.S. Pat. No. 5,052,873, the contents of which are also incorporated herewith by reference. Referring to the drawings, FIG. 1 shows a binder strip 20 disposed adjacent the insertion point 30A of a conventional binding machine 30. A user first inserts a stack of sheets 32 to be bound in an upper opening of the machine. Controls 30B are then activated to commence the binding process. The binding machine operates to sense the thickness of the stack 32 and indicates on a machine display 30C the width of binder strip 20 to be used. Typically, three widths can be used, including wide, medium and narrow. The binder strip includes a flexible substrate 20A having a length that corresponds to the length of the edge of the stack 32 to be bound and a width somewhat greater than the thickness of the stack. A layer of heat-activated adhesive is formed on one side of the substrate, including a low viscosity, low tack central adhesive band 20C and a pair of high viscosity, high tack outer adhesive bands 20B.

Once the user has selected the binder strip of appropriate width, the user manually inserts the strip 20 into the strip loading port 30A of the machine. The end of the strip, which is positioned with the adhesive side up, is sensed by the machine and is drawing into the machine using an internal strip handling mechanism. The machine then operates to apply the strip to the edge of the stack to be bound. The strip is essentially folded around the edge of the stack, with heat and pressure being applied so as to activate the adhesives. Once the adhesives have cooled to some extent, the bound book is removed from the binding machine so that additional books can be bound. FIG. 2 depicts a partial end view of the bound stack 32. As can be seen, the substrate 20A is folded around the bound edge of the stack. The high tack, high viscosity outer adhesive bands 20B function to secure the strip to the front and back sheets of the stack. These sheets function as the front and rear covers and can be made of heavy paper or the like. The central, low viscosity adhesive 20C functions to secure the individual sheets of the stack by flowing up slightly between the sheets during the binding process.

Although the above-described binding technique provides a reliable bind in most applications, problems arise when the sheets of the stack have special coatings. Such coatings are applied to the sheets for various purposes to enhance the characteristics of the sheet, such as improving the ability of the sheet to receive special printing inks. In any event, such coatings very frequently prevent the central adhesive 20C from adhering adequately to the individual sheets of the stack. This results in an unsatisfactory bind where sheets frequently separate from the stack.

In order to address the above-described problem, apparatus were developed for conditioning the stack of sheets prior to binding. This method and apparatus are disclosed in application Ser. No. 10/775,039, filed on Feb. 9, 2004 and entitled "Stack Conditioning Apparatus and Method for Use in Bookbinding". That application Ser. No. 10/775,039, the contents of which are hereby fully incorporated into the present application by reference, is assigned to the assignee of the present application. Referring again to the drawings, FIGS. 3 and 4 depict one embodiment of the prior art conditioning apparatus. The apparatus includes a housing 36 of a size suitable for desktop use. A clamping platen 38 is mounted for lateral movement on a pair of linear guide rails 48A and 48B. Platen 38 includes a vertical member 38A for holding a stack of sheets (not depicted in FIGS. 3 and 4) to be conditioned. A stack clamping carriage 44 is also mounted on the guide rails 48A and 48B for lateral movement. The clamping carriage 44 and platen 38 are coupled together by pair of heavy springs (not depicted) that apply a clamping force to a stack disposed in the cavity 45.

Clamping carriage 44 carries a pair of drive nuts 42A and 42B which receive respective lead screws 40A and 40B. The lead screws 40A and 40B are driven together in either direction by an indexing stepper motor 50. A drive belt (not depicted) couples the motor 50 output to the two lead screws. A stack support member 46 is cantilevered mounted below the clamping carriage 44 and clamping platen 38 and includes a surface 46A. The carriage 44, platen 38 and support member surface 46A form a clamping cavity 45 for receiving a stack of sheets to be conditioned. A multiplicity of piercing blades 52, one of which is depicted in FIG. 8, are supported on respective blade holders 54. In the exemplary conditioning apparatus, there are a total of twelve separate blade holders 54, with the blades 52 being aligned along a common axis. As will be explained in greater detail, the blades function to pierce the edge of each individual sheet of the stack. The use of multiple piercing blades 52, which are driven into the stack at differing times, function to reduce the amount of driving force needed and thus permit the use of a smaller drive motor and other related components. This feature also reduces noise and vibration. FIG. 5 shows four of the twelve blade holders 54 and the associated structure. FIGS. 6 and 7 show further details of the individual blade holders 54.

The piercing blades 52, which are preferably made of ceramic, are each provided with several individual piercing elements 52A (FIG. 8). In the exemplary piercing blade of FIG. 8, there are eleven piercing elements. Each piercing element 52A terminates in a wedge that defines a relatively sharp cutting edge 74 which has a width W of typically 0.025 inches. The spacing P between the edges is typically 0.025 inches. The use of multiple, spaced apart, piercing elements 52A has been found to produce superior results and to further reduce the required driving force. The piercing blades 52 are each approximately one inch in length thereby providing a total length of twelve inches so that stacks with edges of up to twelve inches can be accommodated.

Each piercing blade 52 is secured in a recess 54C formed in the blade holder 54. A blade support block 68 and associated set screw 66 function to hold the blade in place and permit easy blade replacement. The blade holders 54 each have rear openings 54A for pivotally mounting the holder on a common pivot shaft 64 (FIG. 5). The blade holders 54 are driven by a common camshaft 58 having a separate cam surface 58A for each of the blade holders. The respective cam surfaces 58A each engage a cam follower bearing 56 mounted on each of the blade holders. Although not shown, each blade holder 54 includes a return spring connected to hold the cam follower bearing 56 down on to the cam surface 58A. These springs assist in retracting the blades 52 from the stack and force the cam follower bearing 56 to follow the contours of the cam surfaces. The cam surfaces 58A are configured so that, for each complete rotation of the camshaft 58, each of the blade holders 54 will cause each of the piercing blades 52 to reciprocate between a withdrawn position and a piercing position. The amount of blade movement above the surface 46A, which defines the location of the stack edge to be conditioned, is typically between 0.010 and 0.030 inches.

Given the substantial distance between pivot shaft 64 and the location of the blade 52 on the holder, this reciprocating blade movement will fall in a piercing plane that is substantially orthogonal to the stack receiving surface 46A. As used herein, blade movement falls substantially within a piercing plane if the angle of movement is within ±25 degrees of the angle of the plane. Preferably, each of the cutting edges 74 of all of the twelve blades 52 in the exemplary conditioning apparatus fall within this piercing plane. Further, as used herein, a plane defined by at least by that region of the sheet near the edge of the stack to be conditioned is said to be substantially coincident with a plane such as the piercing plane if all of the angles between the respective planes are each within ±25 degrees. As will be explained in greater detail, each sheet of the stack, at least in the region near to edge of the stack being conditioned, will define a sheet plane that will pass through, and be substantially coincident with, this piercing plane. During this relative movement, the blade 52 will be activated at a frequency to ensure that each sheet of the stack is pierced at least once. Note that the stack front and rear cover sheets are secured in place by the outer adhesive bands 20B (FIG. 2) and thus do not rely upon the central adhesive 20C. Such cover sheets do not require conditioning but it does no harm to condition the edges of the cover sheets.

Operation of the prior art conditioning apparatus will now be described in connection with FIGS. 3 and 4. Prior to actuation of a control panel switch (not depicted), the clamping platen 38 and clamping carriage 44 are in a home position for receiving a stack of sheets to be conditioned. In this home position, the stack support member receiving surface 46A is exposed to receive a stack to be conditioned. A pair of relatively strong springs (not depicted), disposed along the respective linear guide rails 48A and 48B, are couple between the platen 38 and carriage 44 and operate to pull the platen towards the carriage. A stop (not depicted) prevents the clamping platen 38 from being pulled closer to the platen 38 than shown in FIGS. 3 and 4. A user first places the stack to be conditioned in the clamping cavity 45, with the stack edge to be conditioned resting on surface 46A. The user then actuates the control panel switch (not depicted) causing stepper motor 50 to drive the clamping carriage 44 by way of the two lead screws 40A and 40B. The direction of movement is towards the stack and the clamping platen 38 on the other side of the stack. The stack is gripped between the extended surfaces associated with clamping carriage 44 and platen 38 to within 0.030 to 0.050 inches from surface 46A thereby preventing the reciprocating blades from contacting the carriage and platen.

Eventually, the driven clamping carriage 44 will contact the stack and will proceed to move the stack and the clamping carriage 38 together, as represented by arrow 75 shown in FIG. 9. Carriage 44 will then start to drive the stack 70 off of the stack support member 46 as shown in FIG. 9 and over the piercing blades 52. While this is occurring, the two springs coupling the carriage 44 and platen 38 together will continue to apply a substantial compression force to the lower portion of the stack 70. This causes the stack 70 to form an essentially solid block so that the individual sheets support one another and are not deflected during the conditioning process.

While the stack 70 is being driven over the piercing blades 52 at a controlled rate, the blades 52 are caused to reciprocate by blade drive motor 62 and the camshaft 58. This reciprocating movement is represented by arrow 76. Assuming that the thickness of the individual sheets of the stack 70 is N inches, the stack is driven in incremental steps of N inches or less. After each of these steps, the piercing blades 52 are reciprocated between the withdrawn position and the piercing position. This insures that each individual sheet of the stack is pierced. Preferably, each advance is only a fraction of the sheet thickness N to add a margin of safety since it is important that each sheet (excluding front and rear cover sheets) be pierced. An advance of ½ of N has been found satisfactory. Thus, for a typical sheet thickness of 0.004 inches, the stack is advanced 0.002 inches prior to each piercing. Stepper motor 50 and drive motor 62 are synchronized to ensure this relationship. Thus, at the end of every 0.002 inches of stack travel, the stepper motor 50 pauses and the drive motor 62 causes camshaft 58 to be rotated 360 degrees. This causes each of the twelve blade holders 54 to be sequentially driven so that each of the twelve blades 52 sequentially pierces the sheets of the stack 70. As previously noted, the blades 52 are set to pierce the sheets of the stack in a typical range of between 0.010 and 0.030 inches.

Once the inner surface of the clamping carriage 44 has reached the piercing plane defined by the reciprocated motion of the individual piercing elements 52A of the twelve piercing blades 52, the stepper motor stops advancing the stack 70. The next step is to return the stack to the home position so that the conditioned stack can be removed. FIG. 10 illustrates a portion of the conditioned stack 70. As can be seen, each of the individual sheets 70A is pierced so that the ends of the sheet are split by the cutting edges 74 of the wedge-shaped piercing elements 52A (FIG. 8). When this occurs, there is a tendency for the fibers of the sheet to tear so that a split is formed in the paper in the region intermediate the points at which adjacent ones of the piercing elements 52A enter the sheet edge.

Although FIG. 10 shows a conditioned stack with splits 72 formed in each sheet, these results are somewhat idealized. FIGS. 11A, 11B and 11C show more typical examples of individual sheets of a stack that have been conditioned. The example of FIG. 11A, a true split 72A is created in a sheet 70A, similar to the splits shown in FIG. 10. This results in a pair of opposing surfaces generally being exposed. In the example of FIG. 11B, it can be seen that sheet 70A has been pierced twice by the piercing element exposing a pair of surfaces 72B. A further example is shown in FIG. 11C where a sheet 70A is pierced in a location such that, rather than forming a split, a single surface 72B is exposed. An individual sheet may have variations of each of these examples along the entire edge of the sheet. Preferably, at least 10 percent and preferably at least 50 percent of the linear length along the edge of the sheets is pierced or torn by the individual piercing elements 52A, to achieve a reliable bind.

In all of the examples of FIGS. 11A-11C, a significant amount of surface area of the fibrous center of the coated paper sheet 70A has been exposed. This is due in part to the fact that the above-described reciprocating action of the piercing blades 52 tends to result in relatively large exposed surfaces that are roughly parallel to the plane of the sheets 70A. These types of exposed surfaces, which are reliably formed on each sheet of the stack, cannot be achieved using prior art methods that somewhat randomly apply abrading action to the stack edge. FIG. 12 shows a portion of a stack conditioned bound using a conventional binder strip 20 and conventional binding machine 30 as depicted in FIGS. 1 and 2. It can be seen that the low viscosity adhesive 20C is adhering to the exposed inner fibrous surfaces of each of the individual sheets. This results in a bound volume where each individual sheet, whether coated or not, is securely held in place.

As previously noted, the very lowest portion of stack 70 is not clamped during the conditioning process thereby enhancing the results of the conditioning. FIG. 14 shows a prior art modification to the lower portion of the FIG. 9 clamping platen 38 and clamping carriage 44 which provides an optimum clamping force for holding the ends of the stack in place. A lower portion of the stack 70, displaced from the end by a significant distance, is gripped securely by a pair of opposing rigid clamping sections 100A and 100B. Although clamping members 100A/100B provide significant compression force, they are sufficiently displaced from the lower end of the stack so as not to interfere with the piercing operation itself. A pair of additional opposing clamp sections 104A and 104B are pivotally supported at the top of the clamp sections by respective hinge pins 108A and 108B. Respective springs 110A and 110 B trapped between respective portions of the clamp sections 100A/100B and the respective pivoting clamp sections 104A/104B to provide a small compression force to the pivoting clamp sections. The springs cause the lower portion of the clamp sections 104A/104B to exert a minimal force needed to hold the ends of the sheets together for the piercing operation. As the piercing operation takes place, the lower end 71 of the stack will tend to expand or fan out due to the splitting of the sheets, with clamps sections 104A and 104B functioning to swing out to accommodate the thicker end of the stack. Note that the lower edges of the pivoting clamp section 100A/100B are disposed a small distance from the stack edge 71 so that the lower clamp section edges will not be struck by the piercing elements 52 of the piercing blade.

The previously described apparatus and method of conditioning a stack of sheets represented a substantial improvement in the art of permitting thermal binding of essentially all types of paper. Nevertheless, further advances are desired. The present invention provides such advances in the art as will become apparent to those having ordinary skill in that art upon a reading of the following Detailed Description of the Invention together with the drawings.

SUMMARY OF THE INVENTION

Apparatus and method for conditioning a sheet or a stack of sheets made of paper that carries a coating which renders the paper resistant to binding using conventional thermal adhesive binder strips. In one embodiment, the edge of the sheets or stack of sheets are conditioned by piercing, splitting and the like, with such conditioning resulting in the edges of the sheet and stack expanding. A subsequent conditioning step is carried out by compressing the edges to remove the expansion. When bound, final sheets and stacks of sheets can be reliably bound using thermal adhesive binder strips notwithstanding the presence of coatings on the paper.

DETAILED DESCRIPTION OF THE INVENTION

Figure 15:
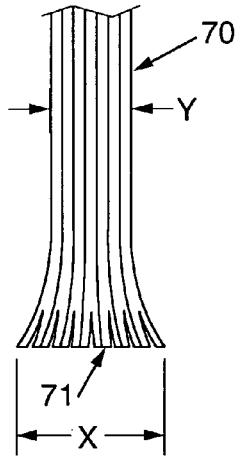
FIG. 15 (PRIOR ART)
FIG. 15 is an elevational side plan view of the lower section of a stack which has been conditioned using prior art techniques.

Referring again to the drawings, FIG. 15 shows a stack 70 of sheets which have been conditioned in accordance with the previously described prior art procedure. The splitting of the individual sheets has caused the thickness of the individual sheets to become enlarged in a direction normal to the plane of the sheet. Thus, the accumulated thickness of the sheets of a stack 70 results in the lower portion 71 of the stack to expand from original thickness Y to an enlarged thickness X. It has been found that for some stack thicknesses, the expansion factor, X/Y can be as high as 1.8. This wider spine width detracts from the appearance of the final bound stack. Further, in some cases it has been found that this expanded thickness has interfered with subsequent binding using a conventional binding machine such as disclosed in the above-noted U.S. Pat. No. 5,052,873.

Figure 16:
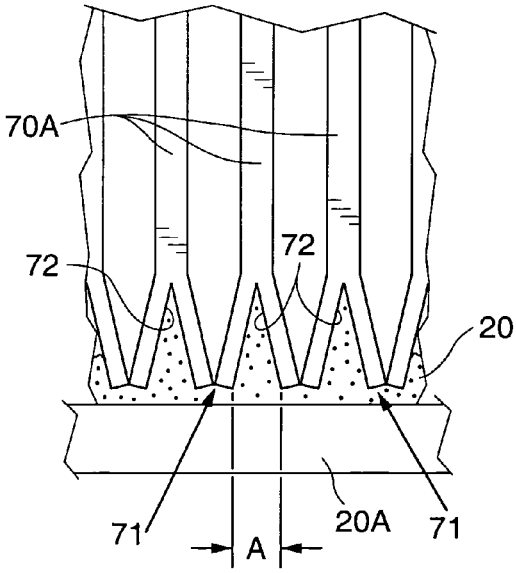
FIG. 16 (PRIOR ART)
FIG. 16 is an expanded elevational schematic view of a cross-section of the lower portion of a stack conditioned in accordance with the prior art after binding is completed.
Figure 17:
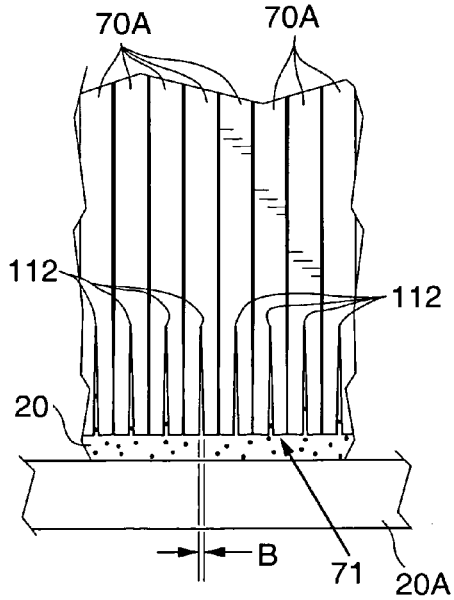
FIG. 17 is an expanded elevational schematic view of a cross-section of the lower portion of a stack conditioned and bound in accordance with one aspect of the present invention.

It was originally believed by the present inventors that compressing the expanded edge of the conditioned stack prior to binding would effectively reverse all or most of the benefits provided by the original conditioning. FIG. 16 shows an expanded schematic view of a conventionally conditioned stack after binding where it can be seen that the molten adhesive 20 has flowed into the various splits 72 (shown idealized) of width A of the sheets thereby resulting in a strong bind regardless of the paper type. If the stack were compressed as shown in FIG. 17 to reduce the split width from A to B, the amount of molten adhesive that is absorbed in the interstices of the stack edge would be reduced to such a degree so as to significantly reduce the strength of the bind. Unexpectedly, it was found that in books made using stacks prepared using significant compression after conditioning according to the method previously disclosed, versus those conditioned but not compressed, the strength with which the sheets are bound is for practical purposes substantially the same.

Figure 18:
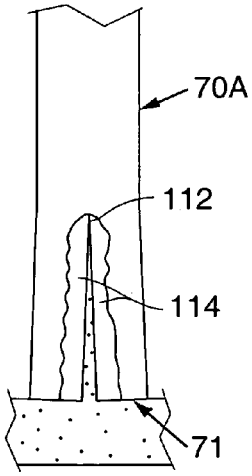
FIG. 18 is an expanded elevational side schematic view of a cross-section of the lower portion of an individual sheet of the bound stack of FIG. 17.

It is believed that this surprising result is due to absorption of the molten adhesive into the fibrous matrix of the split sheets, with such absorbed adhesive greatly enhancing the strength of the bind. FIG. 18 shows a schematic representation of a single sheet 70A from stack 70 of FIG. 17 conditioned using the above described prior art method followed by compression and binding. As can be seen, the splits 112 have been greatly narrowed by the compression so that the volume of molten adhesive within the split is greatly reduced. However, it is believe that the interior regions 114 of the sheet surrounding the split 112 also absorb a significant amount of adhesive thereby offsetting the reduced volume of adhesive present in the paper split. Although there may be some loss of strength due to the reduced area of contact of the absorbed adhesive with the volume of adhesive remaining unabsorbed, in practice the difference is slight.

Figure 9:
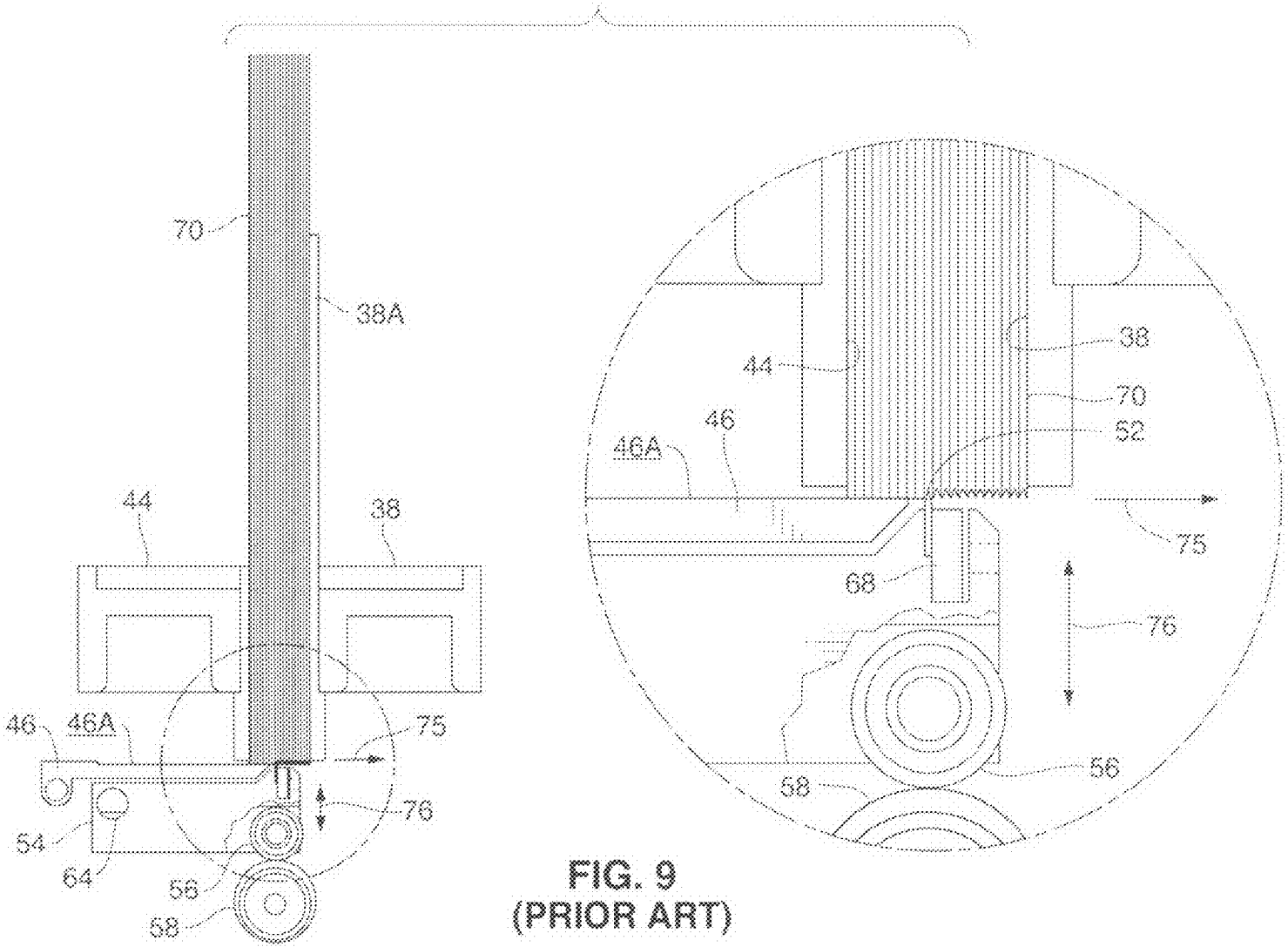
FIG. 9 (PRIOR ART)
FIG. 9 is a side elevational view of the conditioning apparatus of FIGS. 3 and 4 showing a stack being conditioned.
Figure 10:
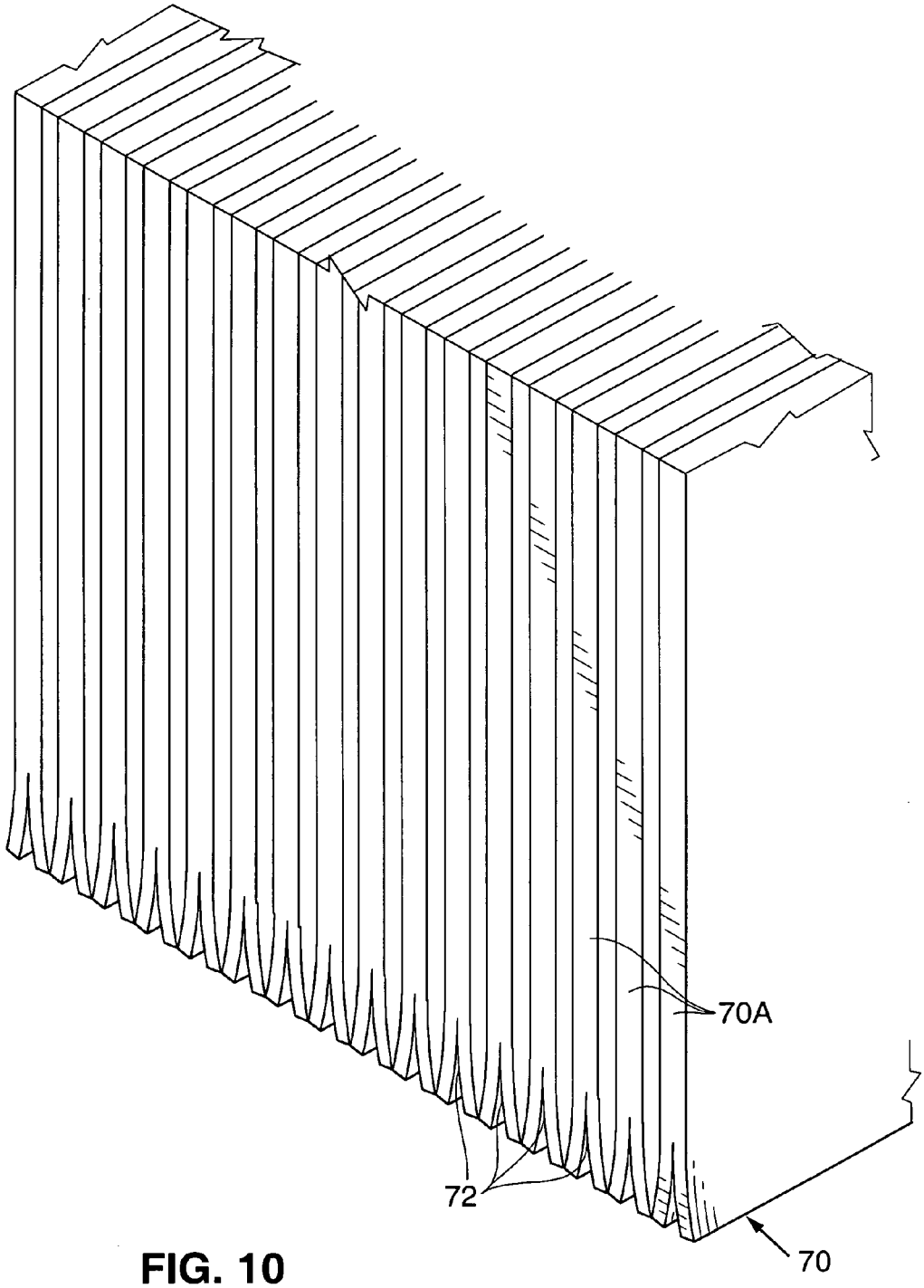
FIG. 10 (PRIOR ART)
FIG. 10 is an enlarged perspective view of a portion of an edge of a stack conditioned in accordance with the prior art.
Figure 11A:
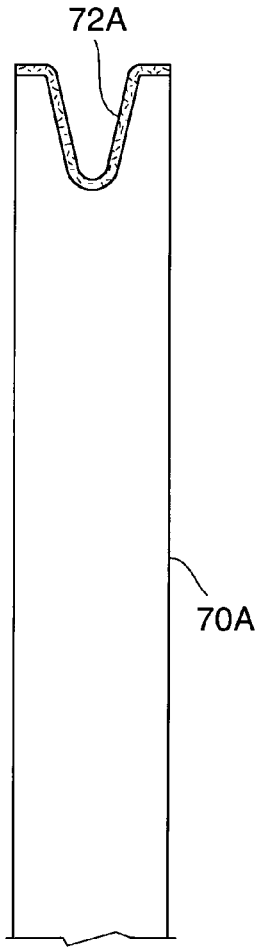
FIG. 11A (PRIOR ART)
FIGS. 11A, 11B and 11C are respective side elevational views of the edges of the exemplary individual sheets of a stack conditioned in accordance with the prior art.
Figure 11B:
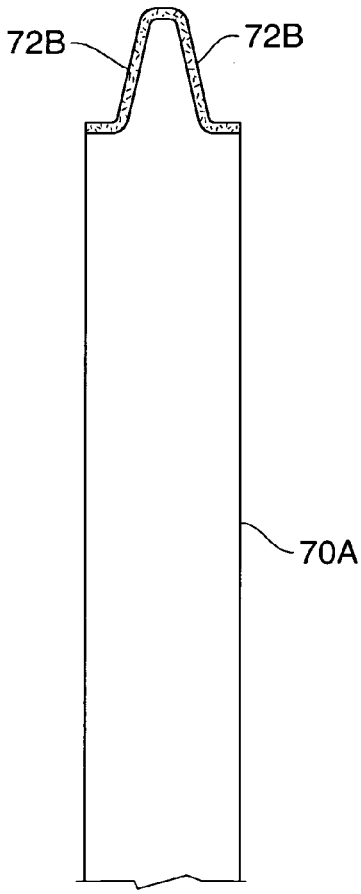
FIG. 11B (PRIOR ART)
Figure 11C:
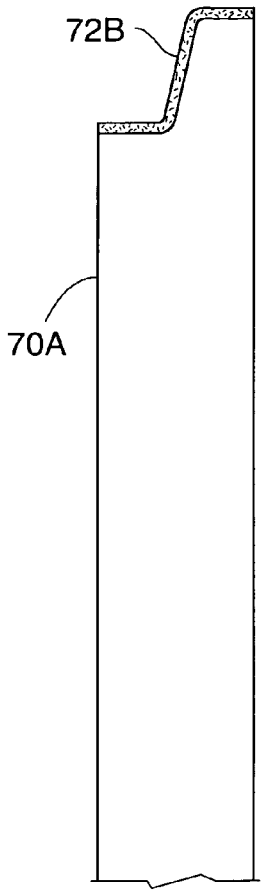
FIG. 11C (PRIOR ART)
Figure 12:
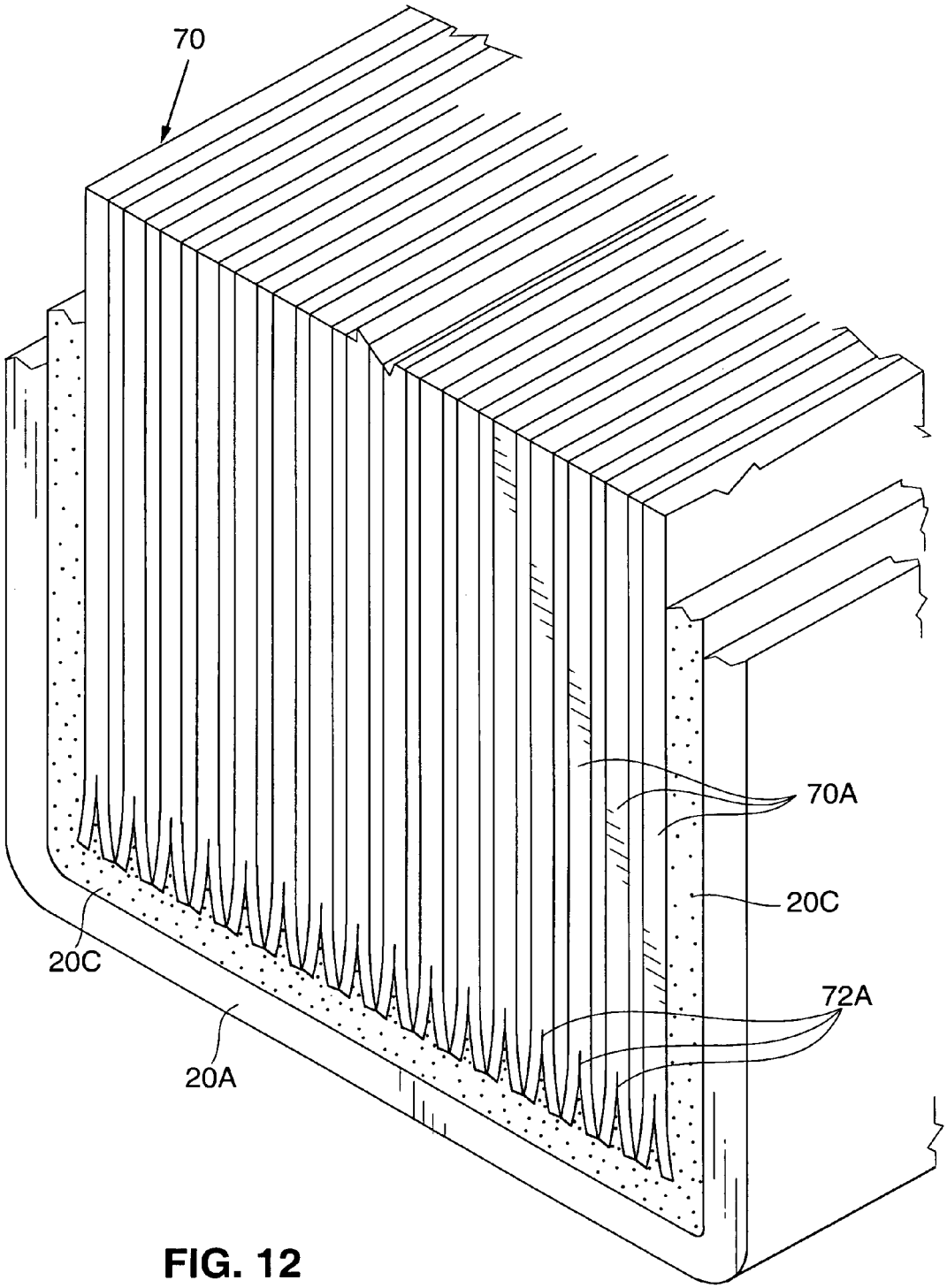
FIG. 12 (PRIOR ART)
FIG. 12 is a perspective view of a portion of a stack conditioned in accordance with the prior art after the stack has been bound using a conventional thermal binder strip.
Figure 13A:
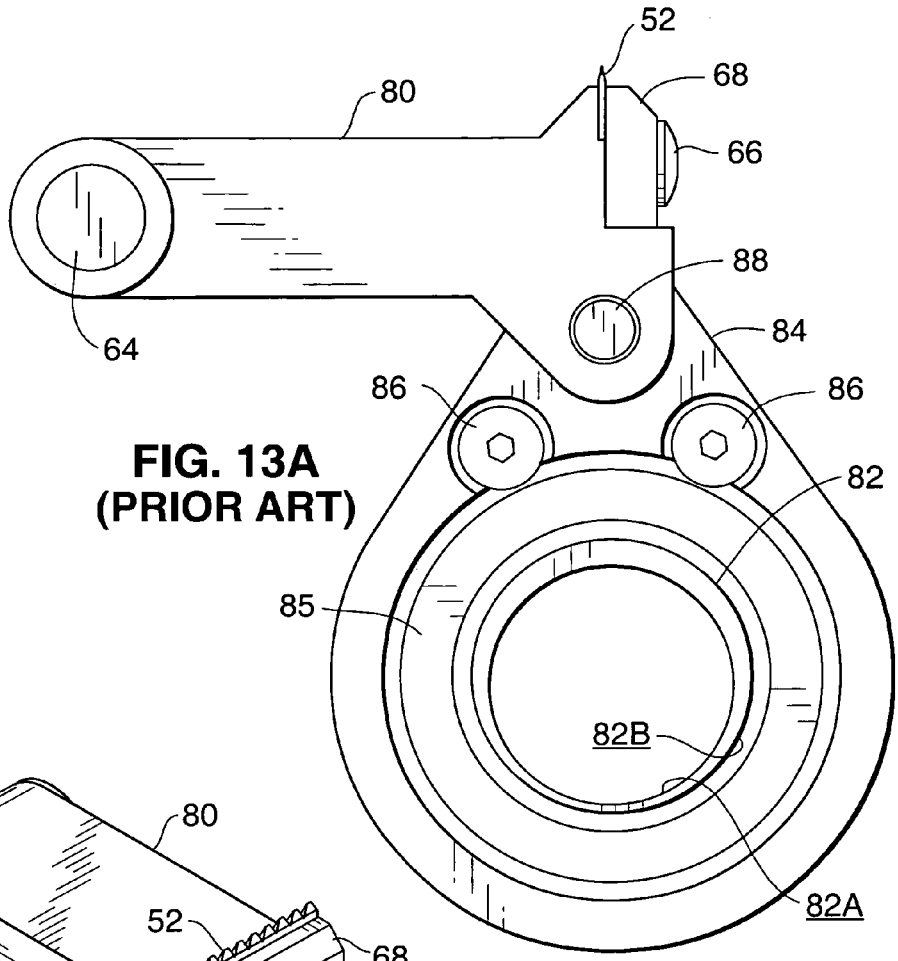
FIG. 13A (PRIOR ART)
FIGS. 13A and 13B are respective side elevational and perspective views of another embodiment of a prior art stack piercing blade arrangement which uses a crank assembly for converting rotational drive motion into reciprocating motion for driving the blades.
Figure 13B:
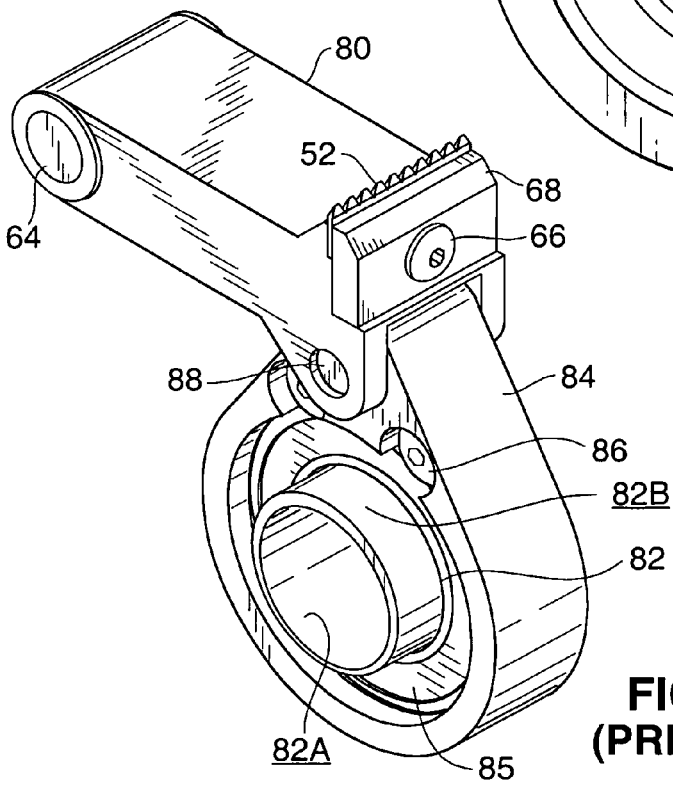
FIG. 13B (PRIOR ART)
Figure 14:
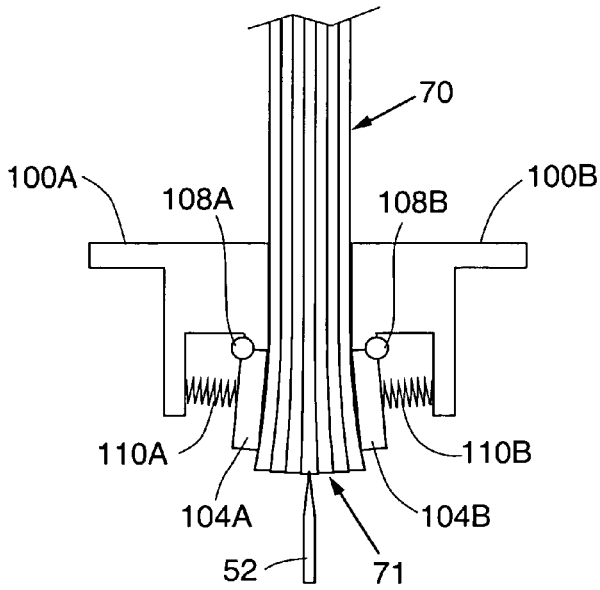
FIG. 14 is a side elevational view of the clamping mechanism of stack conditioning apparatus showing pivoting clamp members which can expand during the piercing operation when the effective thickness of the stack expands.
Figure 19:
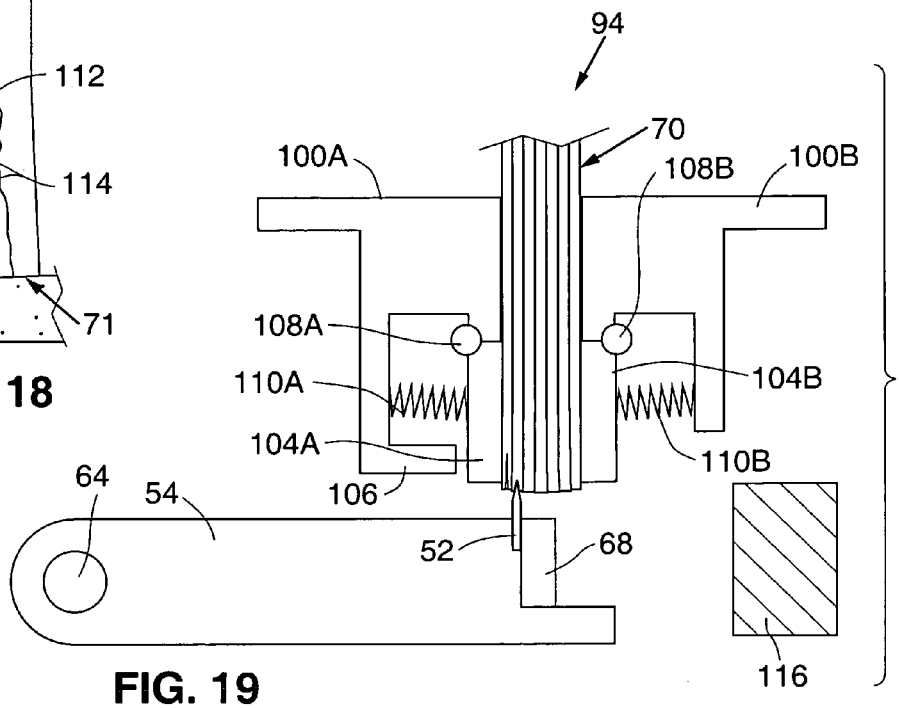
FIG. 19 is an elevational side schematic view of a portion of a conditioning apparatus in accordance with one aspect of the present showing a stack piercing operation being performed.
Figure 20:
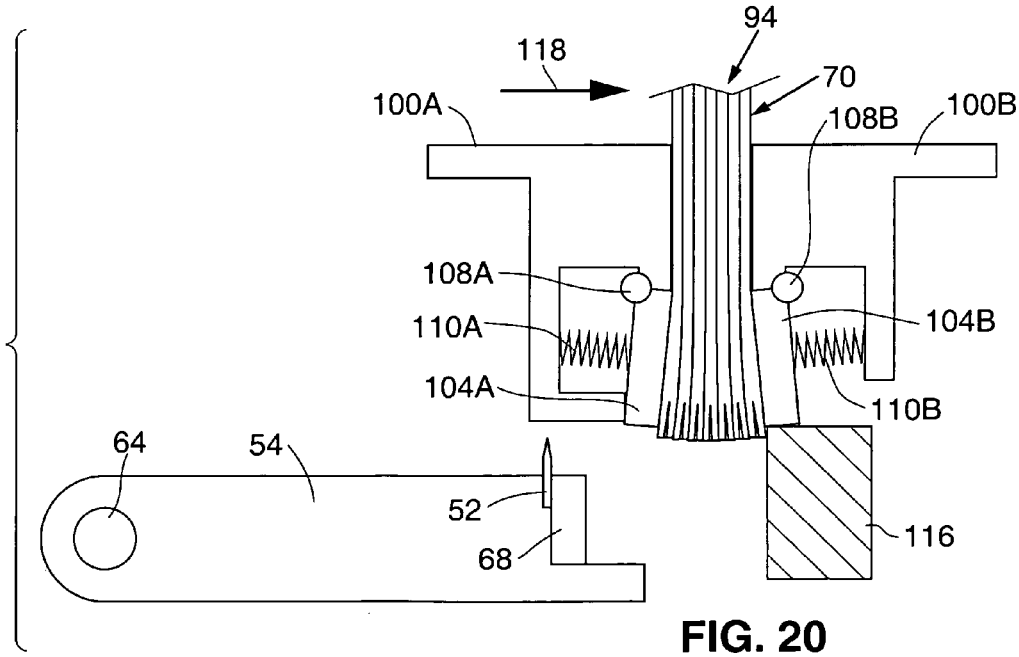
FIG. 20 is an elevational side view of the conditioning apparatus of FIG. 19 showing a stack compressing operation being performed subsequent to the piercing operation.

FIGS. 19 and 20 are schematic views of one embodiment of a conditioning apparatus, generally designated by the numeral 96, which performs the traditional splitting function described above followed by a stack compressing operation. Apparatus 94 includes a modified version of the above-described prior art clamping mechanism to secure the stack 70 during the entire process. Rigid clamp sections 100A and 100B hold the stack in place, with pivoting clamps 104A and 104B securing the lower portion of the stack. Rigid clamp 100A is provided with a stop member 106, the function of which will be described. Initially, clamp sections 100A and 100B position the stack over the stack piercing station for a conventional piercing operation described above. A set of piercing blades 52 is driven up into the lower portion of the stack 70 by a set of blade holders 54 in substantially the same manner as previously described in connection with FIGS. 9. As the stack is moved in the direction indicated by arrow 118 of FIG. 20, the entire lower portion of the stack will be pierced. This may take one or more passes over the piercing blades 52.

The stack 70 is then moved away from the position over and away from the stack piercing station towards a stack compression station that includes a stop member 116 as indicated by arrow 118 of FIG. 20. The upper surface of the stop member 116 is slightly above the lower plane of the stack, 0.06 inches for example. The stop member 116 will eventually contact the lower portion of stack 70 which had just been subjected to the piercing operation. The rigid clamp sections 100A/100B will continue to drive the stack 70 laterally as indicated by arrow 118 causing the lower portion of the stack to deflect slightly. This deflection will cause the pivoting clamp section 104A to swing slightly towards a stop member 106 mounted on clamp section 100A. Eventually, the pivoting clamp 104A will contact the stop member 106 so that the stop member will force the lower edge of the partially conditioned stack 70 against fixed stop member 116. The compression force is preferably at least three (3) pounds per inch of spine length, although it has been found that there is an interaction between the magnitude of the compression force and the duration of the force, and the number of times the force is applied, that is, the number of compression cycles. A smaller force can be used under certain circumstances if the force is applied for a longer duration.

Thus, if an entire spine 12 inches in length is compressed, the total force should be at least 36 pounds. If the spine is compressed in sections, then the force is reduced accordingly based upon the length of the spine section. Further, it is preferable that the compression force be applied multiple times. These multiple compression cycles permit the minimum force to be reduced from the minimum of 3 pounds per inch. It should be noted that prior art binding machines such as disclosed in the above-noted U.S. Pat. No. 5,052,873 inherently apply a compression force during the binding operation of about 15 pounds per foot of spine length or slightly more than 1 pound per inch of spine length. The binding machine applies the force only once for a period of about two seconds before the spine of the book is bound. The combination of force, duration and cycles achieved during binding is not sufficient to create a significant permanent compression of the book. Once the stack has been subjected to the compressing operation one or more times, the stack can be bound using conventional binding methods.

A preferred approach for quantifying the requisite degree of compression is to observe the results of the compression. As previously noted in connection with FIG. 15, the original width of a stack 70 is width Y, with the width being expanded after initial piercing conditioning. Both measurements are taken with the spine edge of the stack free of restraint, although the stack may be clamped in other areas to ensure the sheet remain aligned. As previously noted, the ratio of X/Y can be as high as 1.8 after the piercing conditioning. Preferably, the force and duration of the compression should reduce the amount of expansion by at least one-half. Thus, if the amount of expansion is equal to the quantity X−Y, then the final thickness of the stack after compression should be not greater than the sum of Y+(X−Y)/2.

Figure 1:
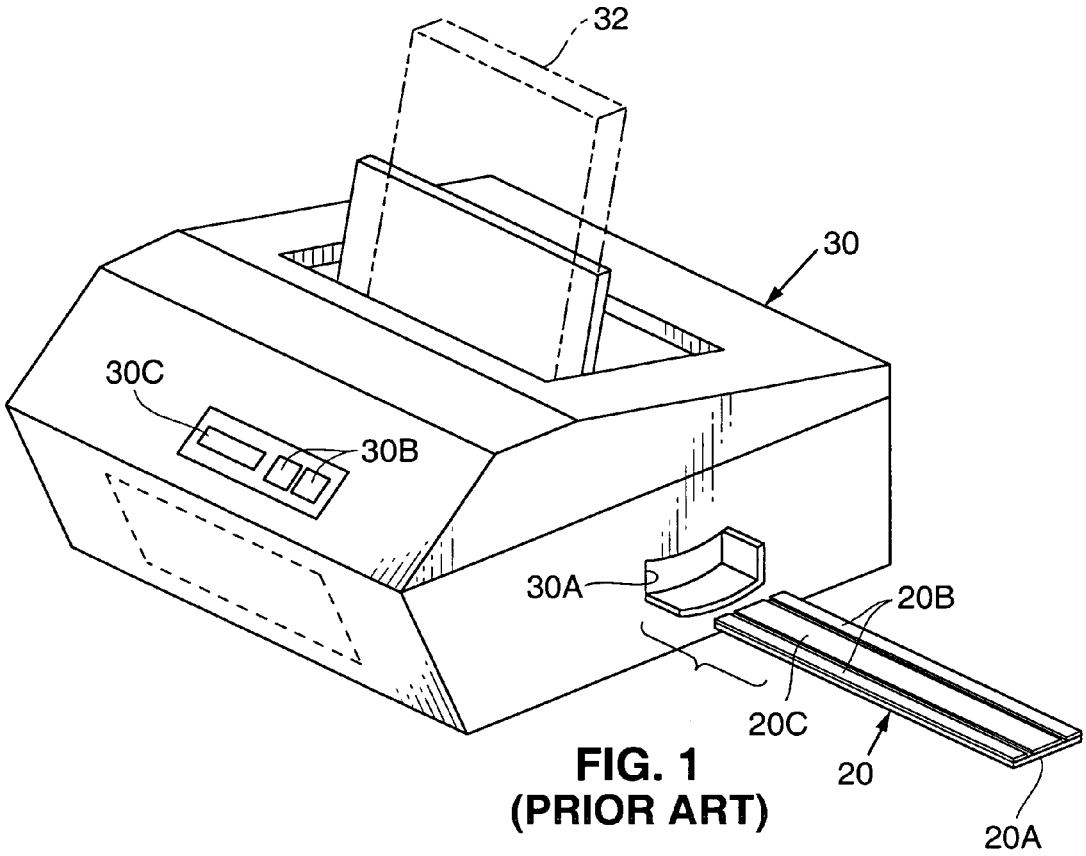
FIG. 1 (PRIOR ART)
FIG. 1 is a perspective view of a conventional binding machine for use in binding stacks of sheets, including stacks conditioned using prior art piercing techniques.
Figure 2:
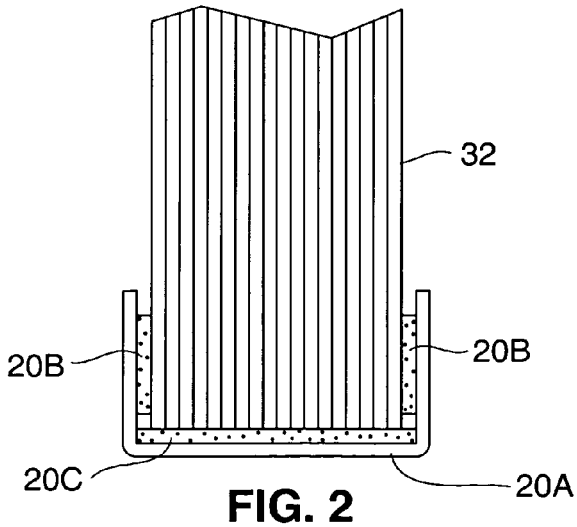
FIG. 2 (PRIOR ART)
FIG. 2 is an end elevational view of a stack of sheets bound by conventional thermally activated adhesive binder strips using the binding machine of FIG. 1.
Figure 3:
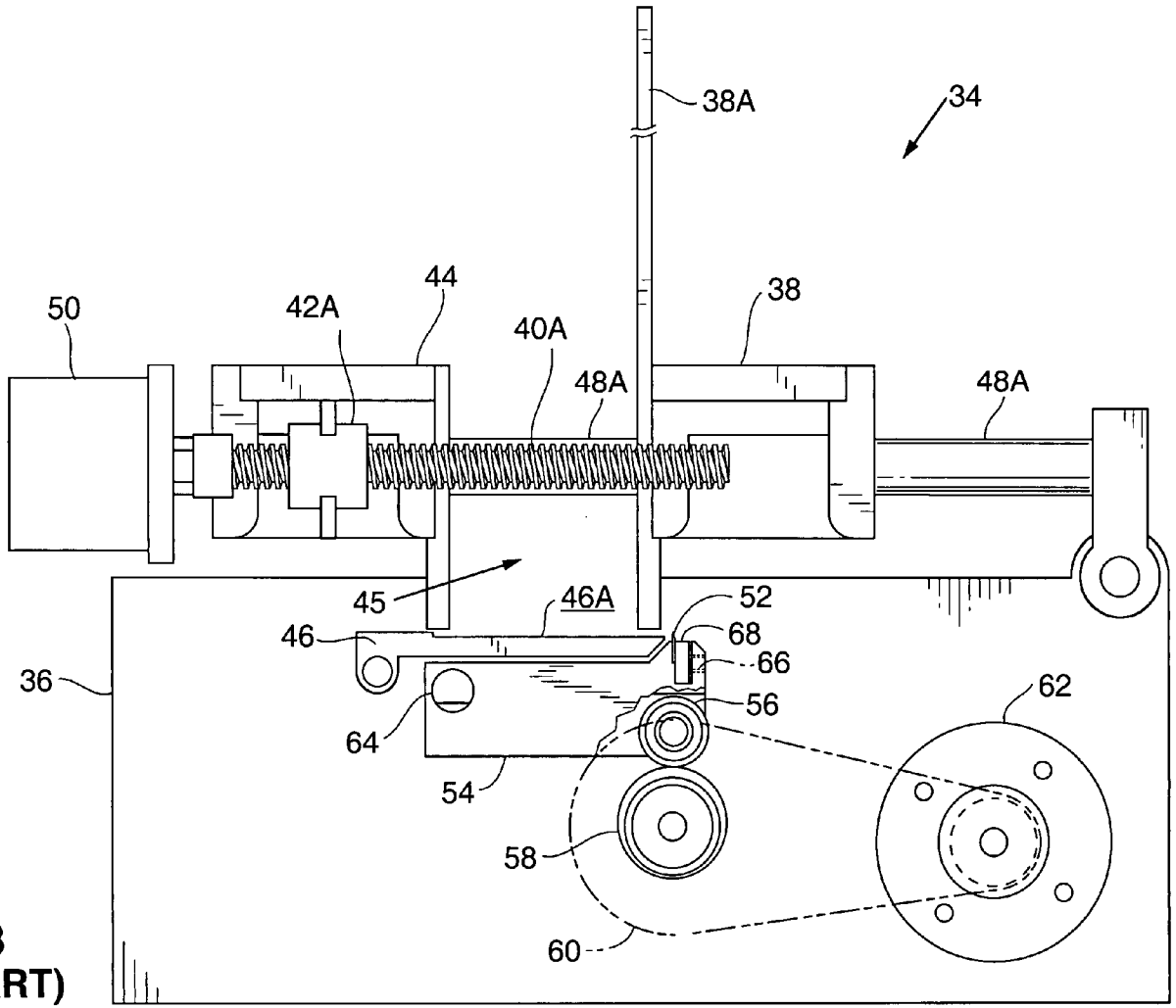
FIG. 3 (PRIOR ART)
FIG. 3 is a side elevational view of a prior art stack conditioning apparatus.
Figure 4:
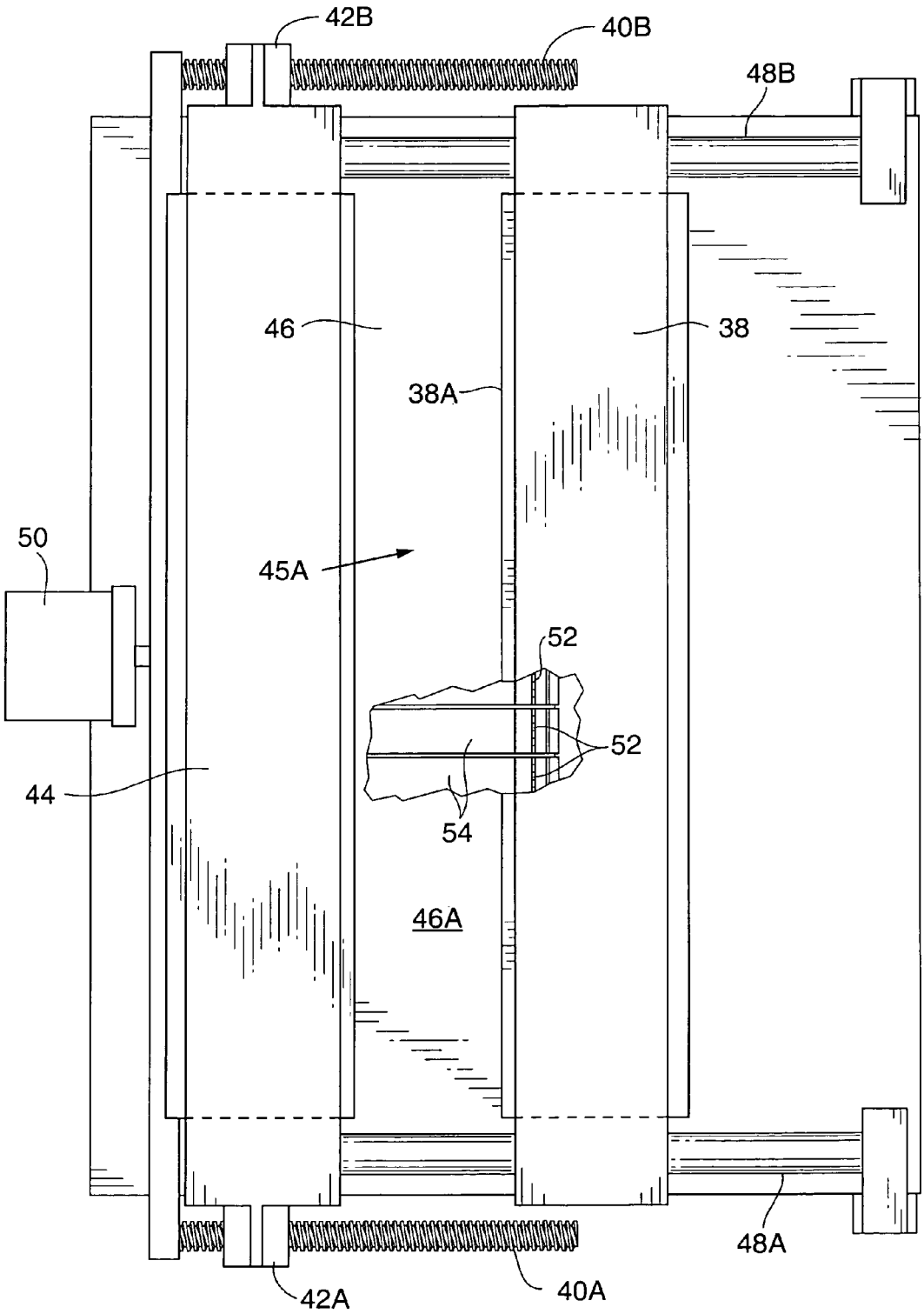
FIG. 4 (PRIOR ART)
FIG. 4 is a plan view of the stack conditioning apparatus of FIG. 3.
Figure 5:
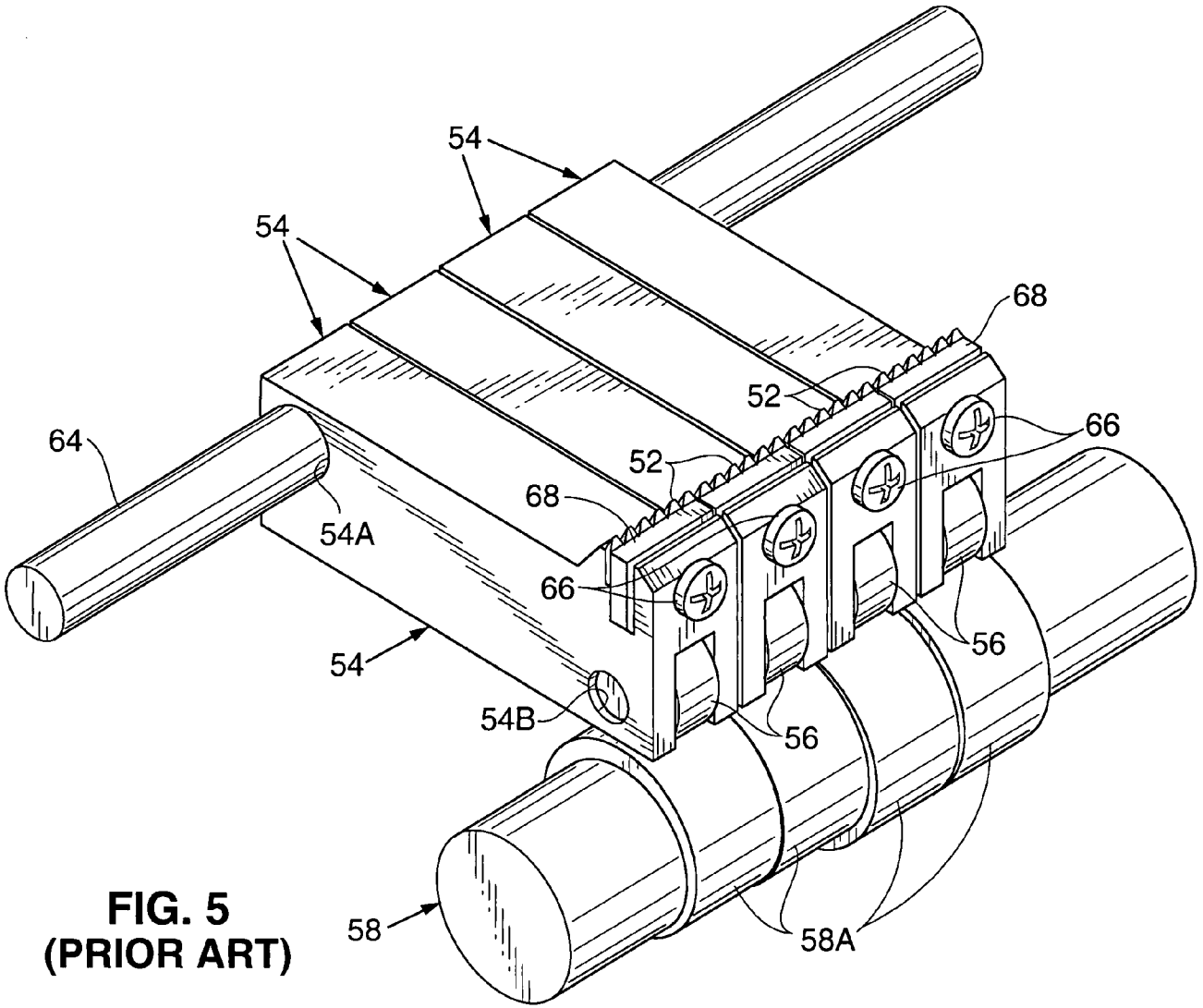
FIG. 5 (PRIOR ART)
FIG. 5 is a perspective view of a prior art stack piercing blade arrangement for use in the conditioning apparatus of FIGS. 3 and 4 for converting rotational drive motion into reciprocating motion for driving the blades.
Figure 6:
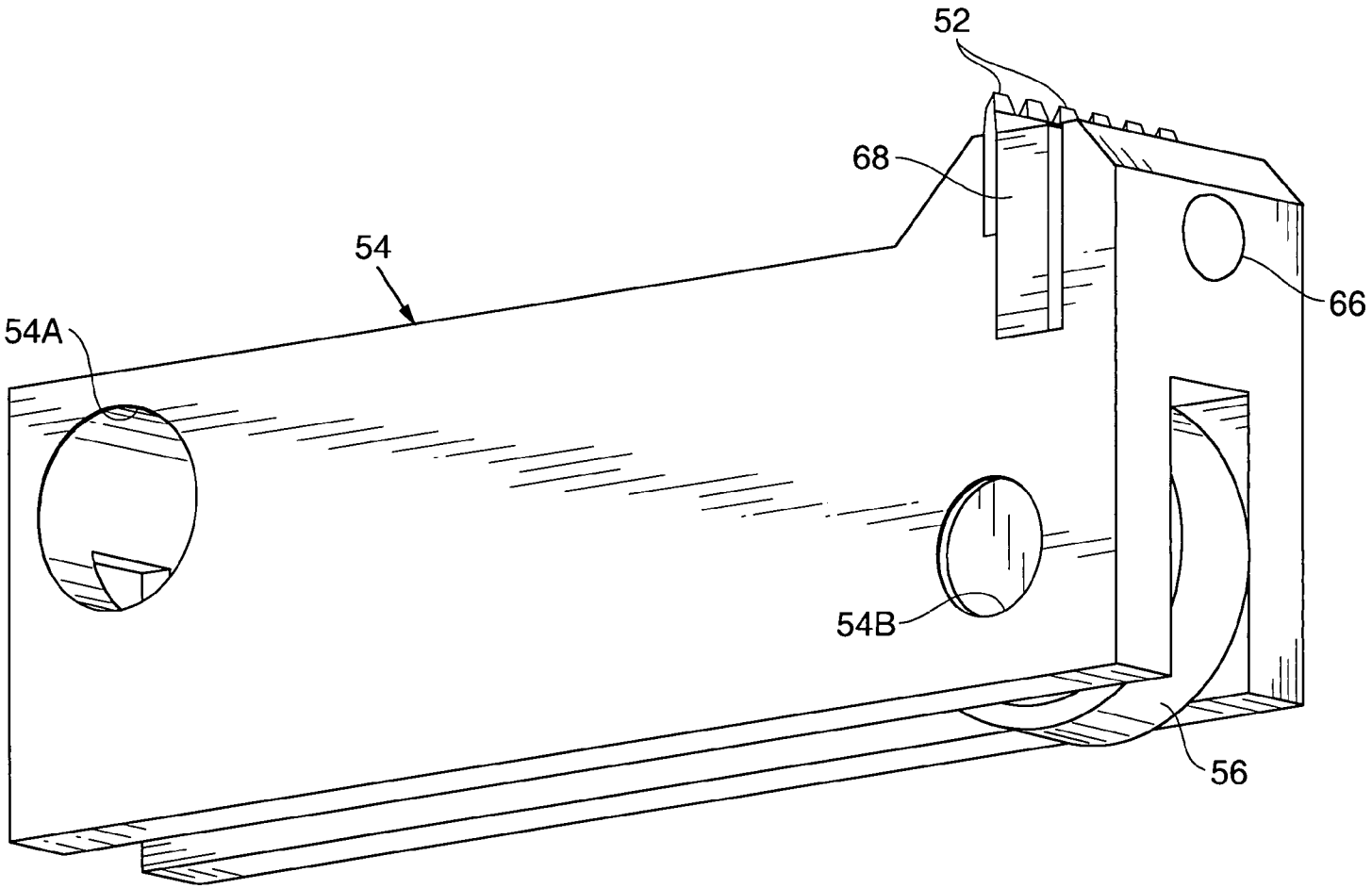
FIG. 6 (PRIOR ART)
FIGS. 6 and 7 are perspective views of one embodiment of a prior art piercing blade holder member.
Figure 7:
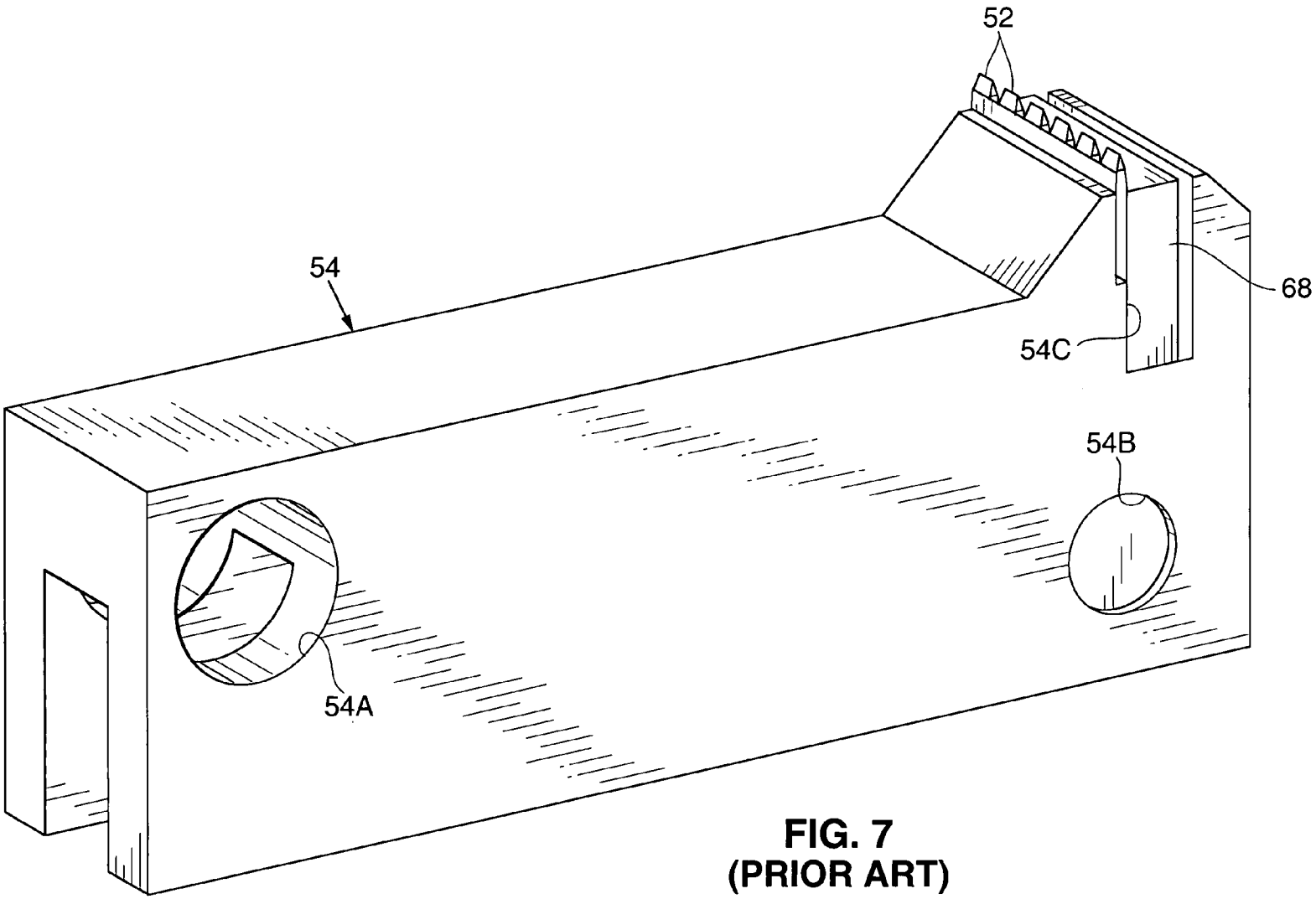
FIG. 7 (PRIOR ART)
Figure 8:
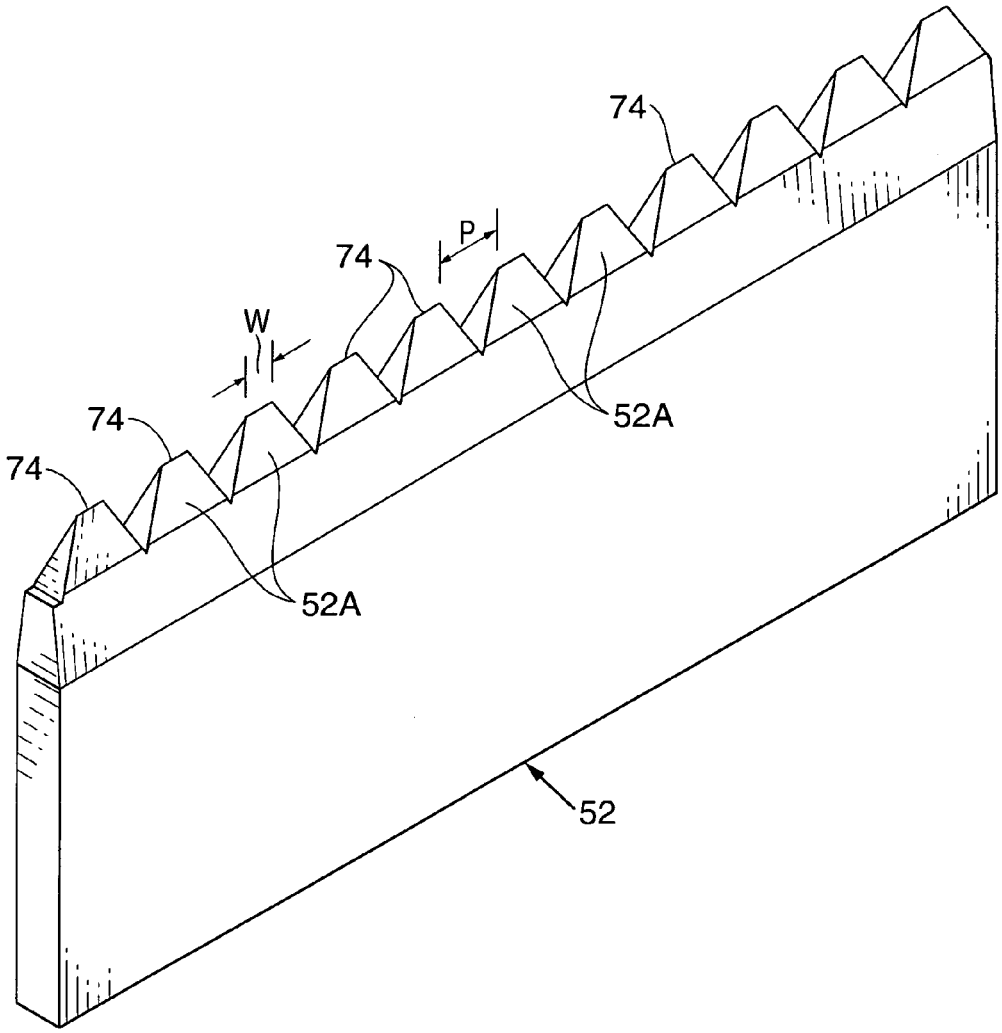
FIG. 8 (PRIOR ART)
FIG. 8 is a perspective view of an exemplary prior art piercing blade showing the individual piercing elements.
Figure 21:
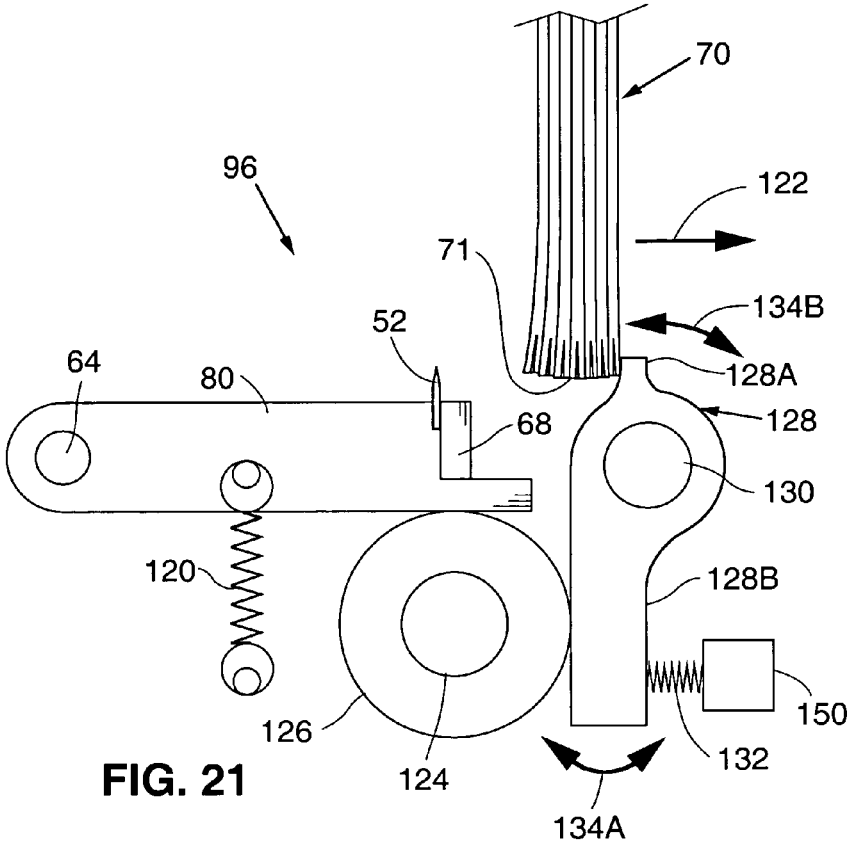
FIG. 21 is an elevational side schematic view of a portion of a conditioning apparatus in accordance with another aspect of the present showing a stack compressing operation being performed subsequent to a piercing operation.

FIG. 21 shows a further apparatus 96 which carries out both the piercing operation and the compressing operation. A set of piercing blades 52 are supported and driven much in the same manner as previously described in connection with FIG. 6. The blades 52 are secured in a blade holder 80 and held in place by a blade support block 68. Preferably, there are multiple blade holders 80 are separately driven by an associated eccentric drive shaft 124. Drive shaft 124 causes a rotating circular guide member outer surface 126 to move through an eccentric path, contacting the lower surface of the associated blade holder 80 so as to reciprocate the piercing blade 52 in an up and down direction as previously described. The clamping and support mechanism is similar to that previously described for FIGS. 19 and 20.

After the piercing operation is completed, the stack is moved from the piercing station in the direction of arrow 122 towards a compressing station. A plurality of reciprocating hammers 128 are provided, with a hammer 128 preferably being associated with each of the plurality of blade holders 80. Hammer 128 is pivotally mounted on a support shaft 130 and includes a shaft member 128B which, along with blade holder 80, engages the eccentrically driven guide surface 126. A spring 132 is positioned between the hammer shaft 128B and a fixed mounting block 150, with the spring functioning to bias the hammer shaft 128B against surface 126. Thus, rotation of the eccentric drive shaft 124 causes the hammer shaft to be reciprocated as indicated by arrow 134A. Reciprocation of hammer shaft 128B causes a hammer head 128A to also reciprocate as indicated by arrow 122, with the direction of hammer head 128A reciprocation being generally normal to the direction of blade reciprocation.

The hammer head 128A is positioned to engage the lower portion of the stack 70. Like the piercing blades 52, there is a plurality of hammers 128, with each hammer preferably being driven at differing times. The stack 70 is moved towards the hammers at a reduced velocity compared to the maximum velocity of the hammer heads. Thus, as the stack moves, it meets with one hammer and then another, with each contact compressing only a portion of the stack edge. Because only a portion of the stack is being compressed at any time, the peak force and power that must be delivered are reduced from what would be needed with a single compression bar. This permits the use of a smaller motor and a lighter and lower cost mechanism.

Figure 22A:
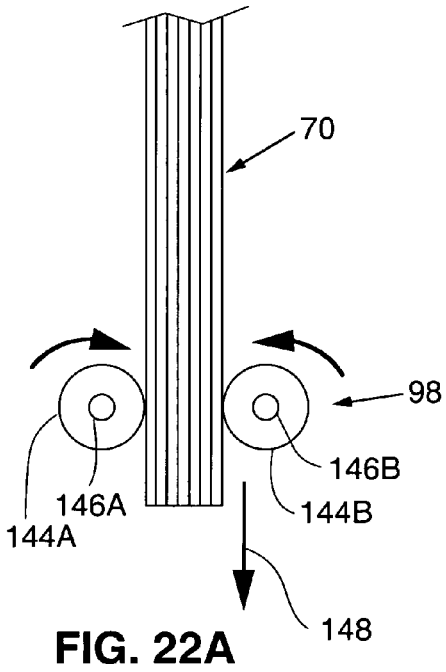
FIGS. 22A and 22B depict respective plan and side elevational views of a stack compressing apparatus in accordance with a further aspect of the present invention.
Figure 22B:
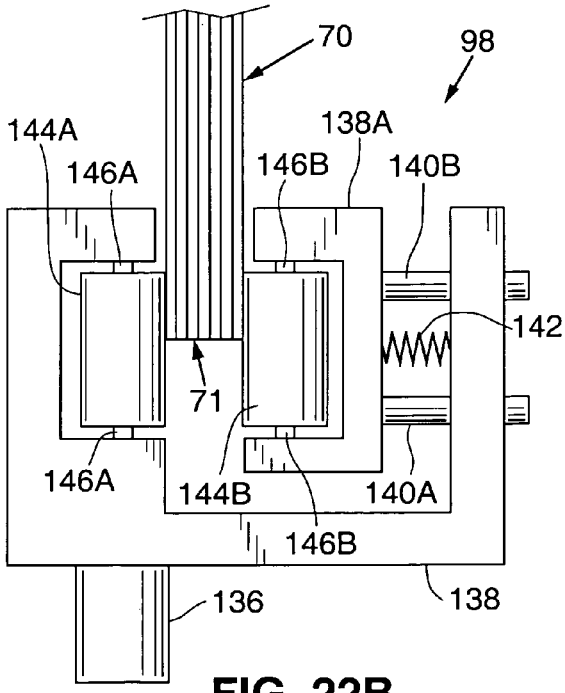
Figure 23A:
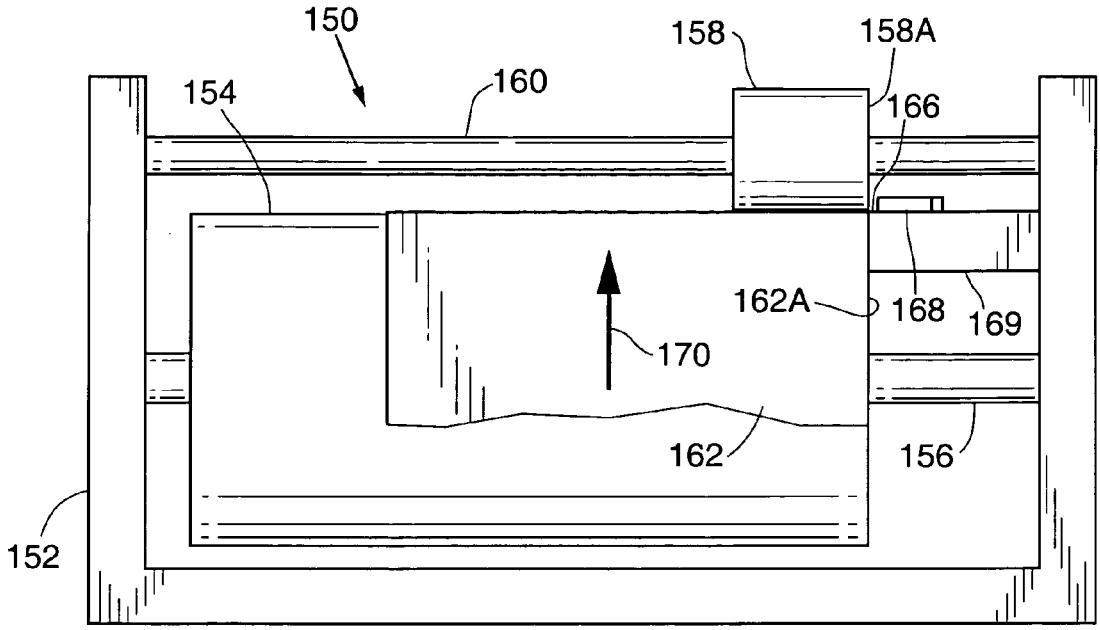
FIGS. 23A, 23B, 23C and 23D are respective front, side, plan and perspective views of a single sheet splitting machine in accordance with one embodiment of the present invention.
Figure 23B:
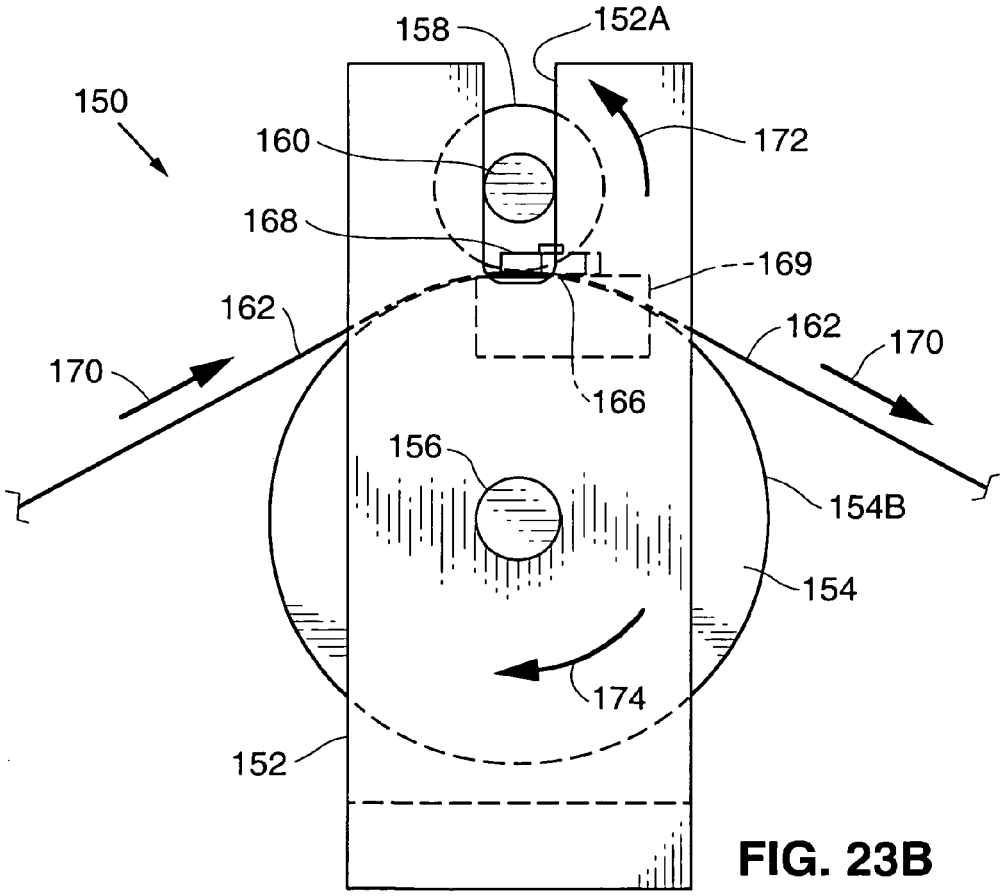
Figure 23C:
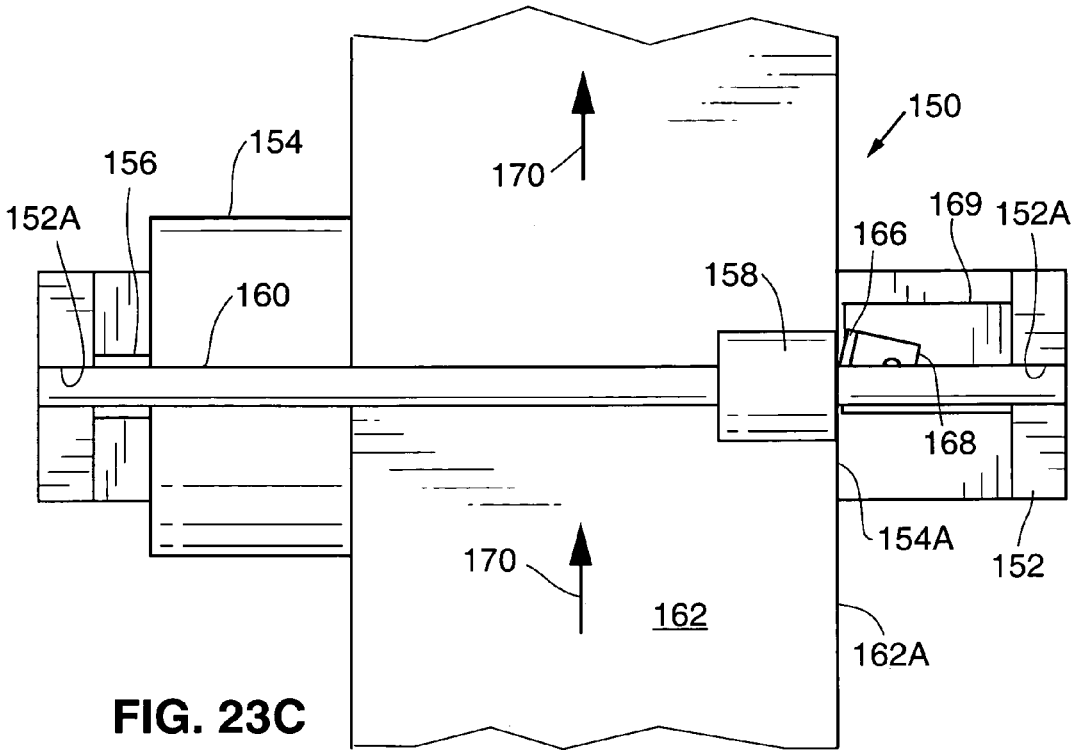
Figure 23D:
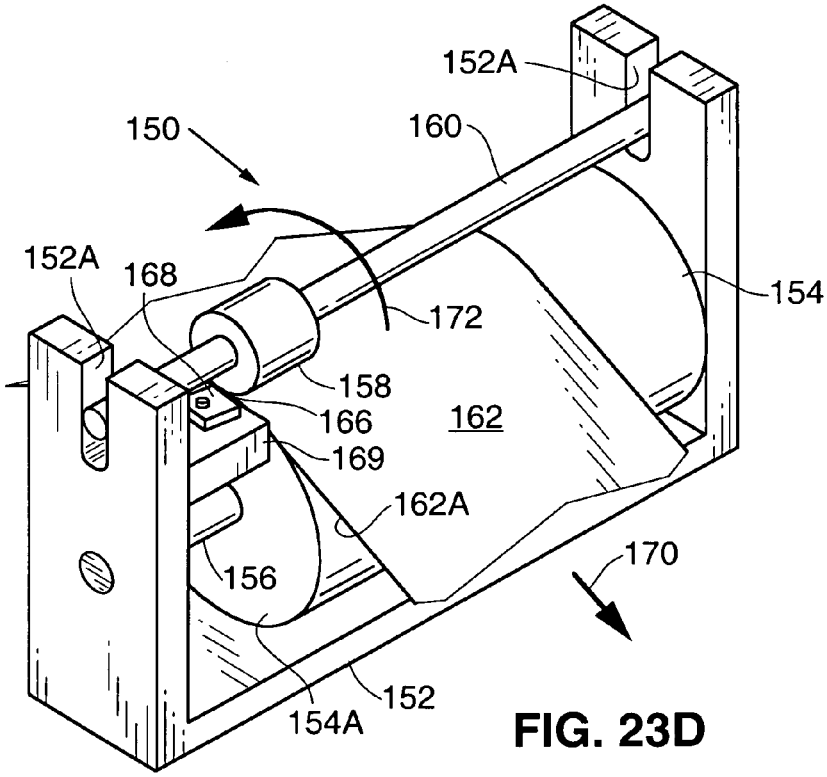

A still further apparatus for carrying out a compressing operation is disclosed in FIGS. 22A and 22B. FIG. 22A, which is a plan view, shows a pair of nip rollers 144A and 144B which engage the expanded spine region of the stack, preferably including the stack edge itself. The rollers 144A and 144B rotate about an axis normal to the spine edge of the stack 70 so that the stack is drawn between the rollers in the direction of arrow 148. The side view of FIG. 22B shows the spine edge of the stack disposed between rollers 144A and 144B, with roller 144A being mounted on support shaft 146A and roller 144B being mounted on support shaft 146B. Support shaft 146A is rotatably mounted on a main support mechanism 138 as is a drive motor 136 which drives the support shaft. Support shaft 146B is rotatably mounted on a movable minor support bracket 138A. The minor support bracket 138A includes a pair guide rails 140A and 140B which extend through respective spaced-apart openings (not designated) in the main support bracket 138 so that the minor bracket can be moved with respect to the main bracket in a direction along the guide rails. A compressed spring 142 is disposed between the main support bracket 138 and the moveable minor support bracket 138A so as to force nip roller 144B towards roller 144B.

When a stack 70 that has gone through a piercing operation is positioned near the gap between the nip rollers 144A and 144B, including the expanded edge of the stack. Driven roller 144A will draw the stack between the rollers and apply a compression force, with the magnitude of the force being largely determined by spring 142. This action will compress the spine edge of the stack, with only a small portion of the stack being compressed at any one time. Preferably, the stack is passed through the compressing apparatus 98 multiple times.

Rather than conditioning a stack of sheets prior to binding, in certain circumstances it is advantageous to condition the individual sheets. Generally, an edge of the sheet to be bound is conditioned by cutting or splitting the sheet edge followed by compressing the sheet edge. This approach would be especially advantageous in a paper manufacturing facility where elongated paper webs are formed and then cut into individual sheets. The conditioned sheets can the sold to consumers in the same manner as conventional sheets, with the end user applying printing or the like to the sheets and then binding the sheets into a book using the previously described thermal adhesive desktop binding apparatus.

FIGS. 23A, 23B, 23C and 23D depict various view of a splitting machine station, generally designated by the numeral 150, which is suitable for conditioning a single sheet of paper, preferably when the paper is still in web form. Station 150 includes a frame 152 which supports a driven roller 154 by way of a shaft 156. Although not shown, shaft 156 is driven by a motor which causes roller 154 to rotate. A second roller 158 is also supported on frame 152 by way of a shaft 160. A continuous paper web 162 to be conditioned is pinched between rollers 154 and 158 and is drawn between the rollers in a direction indicated by arrows 170. Roller 154 is preferably made of metal such as aluminum, with roller 158 being made of, or covered by, a resilient material such as rubber. Shaft 160 supporting resilient roller 158 is mounted in a pair of opposing cutouts 152A formed in frame 152 directly over shaft 156 of roller 154. A spring mechanism (not depicted) applies a downward force on shaft 160 so that roller 158 will force the paper web 162 against the surface 154B of the larger metal roller 154. Thus, as roller 154 is rotationally driven in the direction indicated by arrow 174, the paper web 162 is pulled between the rollers, with the friction between the rubber roller 158 and the web causing the roller to also rotate in a direction indicated by arrow 172. As can best be seen in FIG. 23B, the paper web 162 approaches large roller 154 and exists the roller at angles such that the web is wrapped around a significant portion of the circumference of the roller. A roller 154 of about 6 inches in diameter has been found suitable for this purpose, with the paper web engaging the roller surface 154B for approximately 60 degrees of the circumference of the roller.

Figure 24:
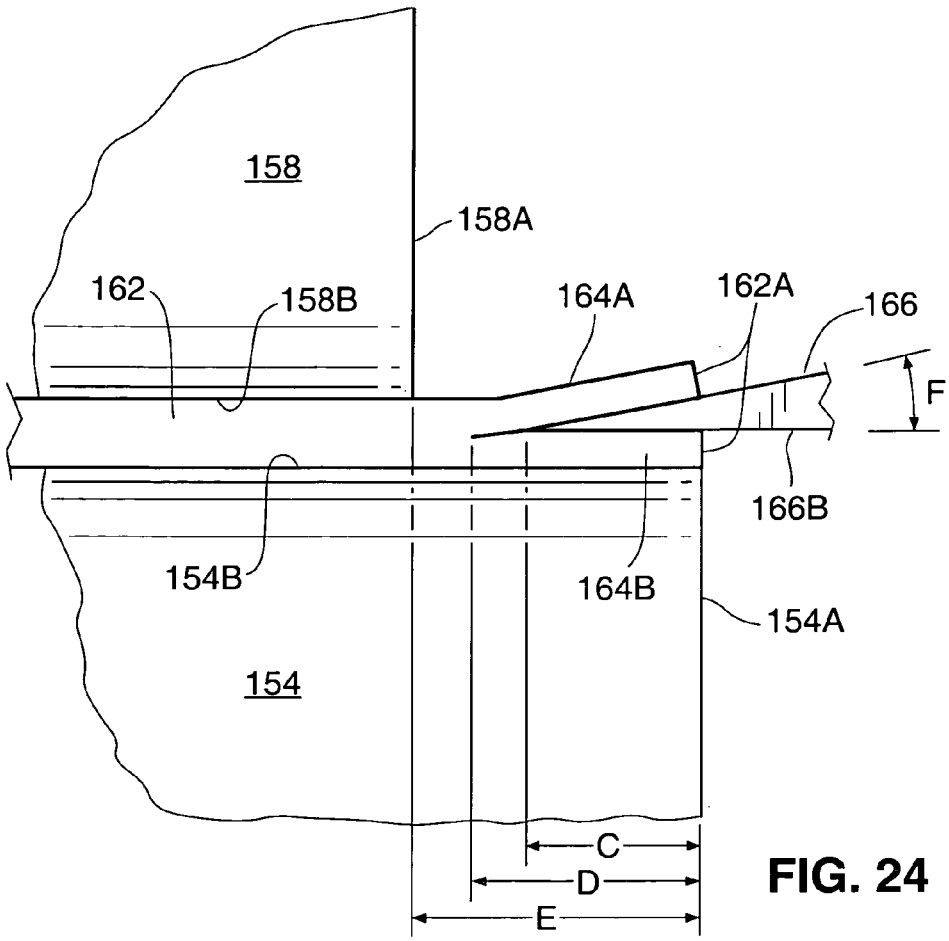
FIG. 24 is an enlarged view of a section of the splitting machine of FIGS. 23A, 23B, 23C and 23D showing details of an edge of a single sheet of paper being split.

FIG. 24 is an enlarged view of a portion of the splitting machine station 150, showing a small section of the upper rubber roller 158, having an outer edge 158A, disposed above the large metal roller 154, with roller 154A having an outer edge 154A. A small outer section of the paper web 162 is shown gripped between the two rollers. A cutting blade 166 (see also FIG. 23A) is supported on frame 152 by way of a blade support bracket 168 and a mounting block 169. As can best be seen in FIG. 24, blade 166 is supported such that the cutting portion 166B of the blade can engage the edge 162A of the web 162 as the web is driven by the blade. The objective is to split the edge 162A in the center of the edge along the full length of the web so as to produce a pair of split paper end portions 164A and 164B. Given that a typical sheet of paper is only 0.004 inches in thickness, it can be seen that the splitting operation requires fairly close tolerances in the construction of the machine, with such tolerances being well within the capability of machine designers of ordinary skill. Although not shown, the blade support bracket 168 is provided with various alignment mechanisms to permit the blade to be precisely positioned as desired.

Preferably, the paper web 162 is positioned over large roller 154 so that the edge 162A of the web is aligned with the edge 154A of the roller as shown in FIG. 24. Thus, the lower surface of the web 162 in the region of the splitting is fully supported by the roller surface 154B. In order to facilitate the desired splitting, the upper surface of the web 162 is not supported near the edge. The edge 158 of the rubber roller 158 is typically displaced a distance E of about 0.020 inches for the paper edge 162. This permits the upper split end portion 164A of the web to be displaced upwards during the splitting operation as shown in FIG. 24. The penetration distance C of the blade 166 into the paper edge 162A is typically 0.010 inches. This produces a split having a depth D of typically 0.015 inches, with about 0.005 inches of that depth distance located past the cutting edge of the blade being due to tearing of the paper. The depth D of the slit is at least 0.005 inches, although preferably deeper as noted above.

Figure 26A:
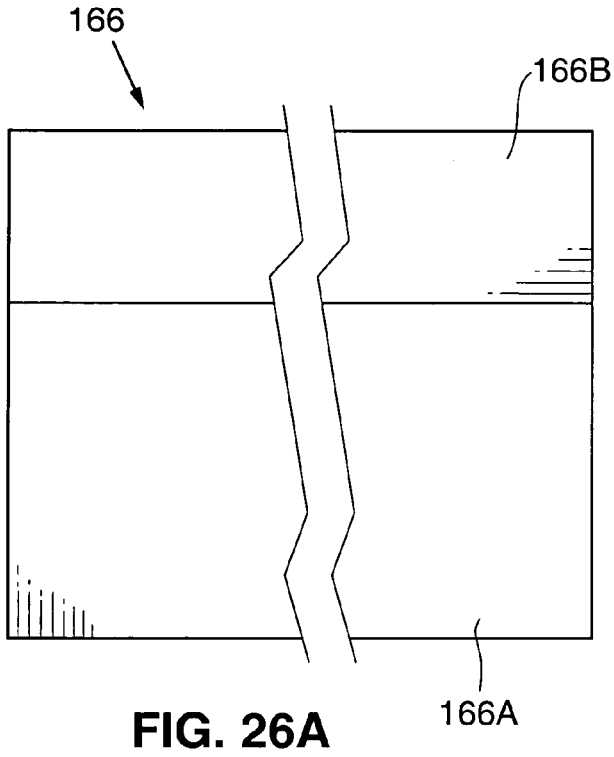
FIGS. 26A, 26B and 26C are respective front, side and perspective views of the cutting blade.
Figure 26B:
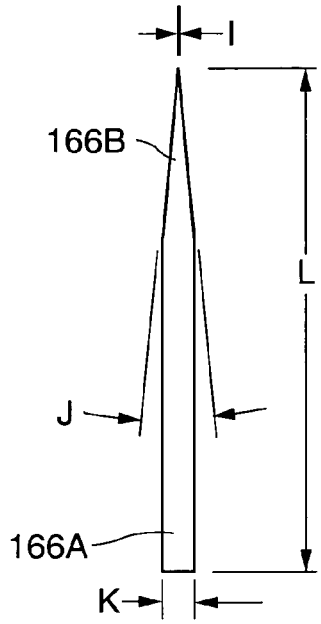
Figure 26C:
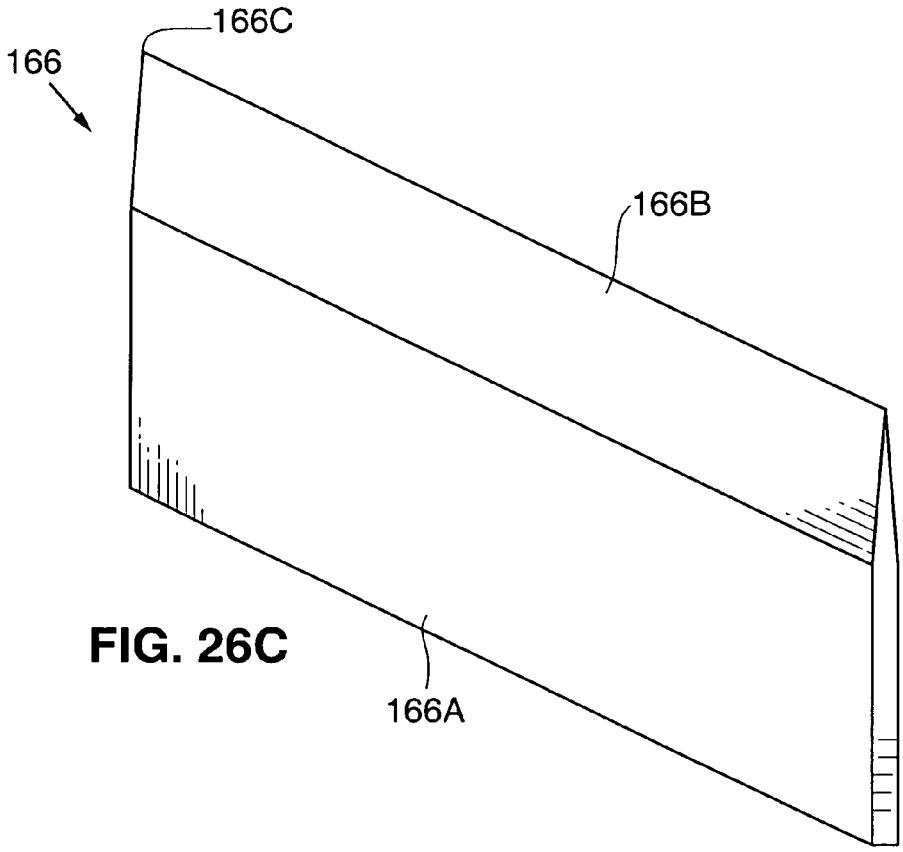

FIGS. 26A, 26B and 26C show further details of one embodiment of cutting blade 166. Blade 166 is preferably made of a very hard material, examples being tungsten, carbide, ceramic or hardened steel. Blade 166 includes a body portion 166A which has a typical thickness K of 0.030 inches, and a cutting portion 166B. The total width L of the blade, including both the body and cutting portions is about 0.5 inches. Cutting portion 166B has opposing surfaces that are at an angle J with respect to one another, with the angle typically being from 10 to 15 degrees. The cutting tip of the blade has a width I of no more than 0.001 inches.

Figure 25A:
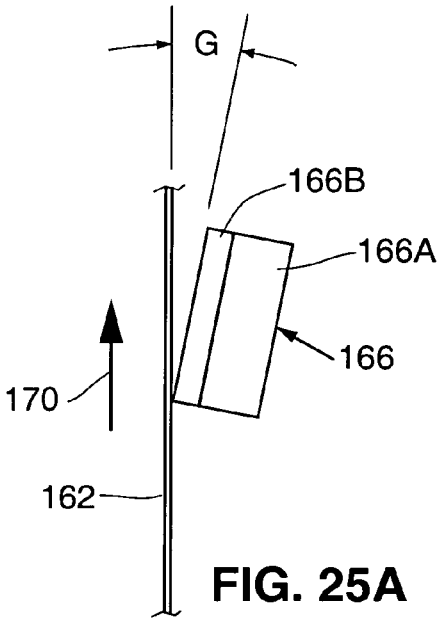
FIG. 25A is a view of a section of the single sheet splitting machine showing the geometry of the cutting blade relative to the edge of a sheet being split, with FIG. 25B being an enlarged view of a section of FIG. 25A further illustrating the blade/sheet edge geometry.
Figure 25B:
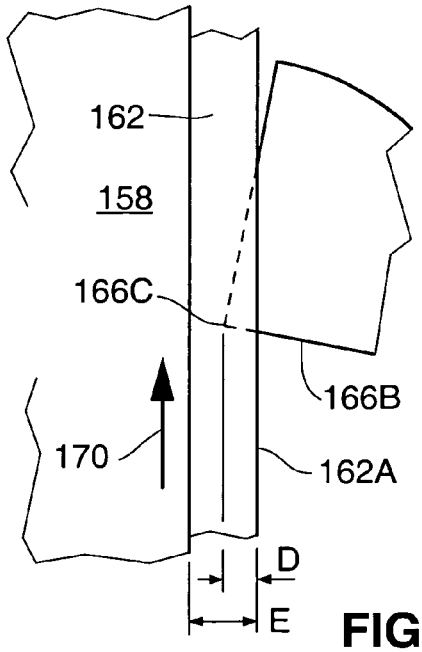

As shown in FIGS. 25A and 25B, the cutting blade 166 is positioned at an angle J with respect to the edge of the web 162 being cut. Angle J is typically between 5 and 15 degrees. As can be seen by the direction arrows 170 of FIGS. 25A and 25B, the web 162 is driven in a direction relative to the blade 166 such that tip 166C of the blade forms the leading edge of the cutting action. This somewhat unorthodox arrangement has been found superior to driving the web in the opposite direction relative to the blade where the leading edge of the cutting action would be limited to the sharpest edge of the blade.

As the terms split and splitting are used in the present application, a sheet edge is split if it results in two opposing split end portions 164A and 164B. It should be noted that although the objective is to provide a continuous split in the sheet edge along the full length of the edge 162A so as to produce continuous split end portions 164A and 164B, the benefits of the present invention are provided even if only 25 percent of the edge of the final sheet is split. Further, it is preferably that the splitting proceed down the center of the edge 162A since, among other things, should the blade exit the web edge so that the blade is no longer engaging the paper, it has been found that the blade has some tendency to resist being directed back into the paper.

Figure 30:
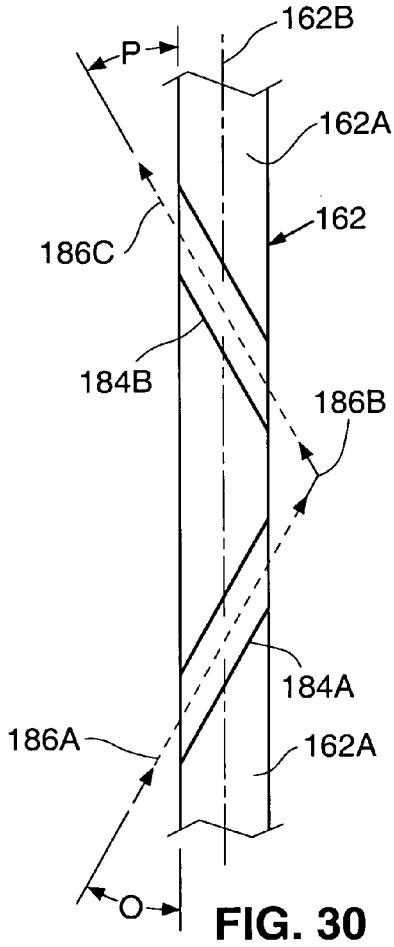
FIG. 30 is a schematic diagram illustrating conditioning of a sheet by forming multiple splits in the sheet edge rather than the preferred continuous split.

FIG. 30 is a schematic representation of one exemplary path of the cutting blade where the blade does periodically exit and reenter the paper edge 162A. This back and forth action may be a result of a failure to adequately control the position of the blade 166 relative to the sheet edge 162A. Assume that blade 166 enters the edge of the sheet 162A at an angle O with respect to the longitudinal axis 162 B of the sheet edge rather than being substantially coincident to the axis as previously described in which case the angle is ideally zero degrees. The blade will form a first split 184A across sheet edge 162A, with the angle of the split being at the angle O. Typically, angle O is small so that the length of split 184A is significant compared to the thickness of the edge 162A of the sheet, with the angle in the drawings being exaggerated for purposes of illustration. At point 186B of the relative movement of the blade and sheet are such that the blade reenters the sheet at an angle P with respect to axis 162B so as to create a second split 184B across the edge 162A at angle P. This back and forth action could continue along the full length of the edge. This action, although not preferred, could provide adequate splitting. The angles O and P should be less than 10 degrees in accordance with one aspect of the present invention.

Figure 27:
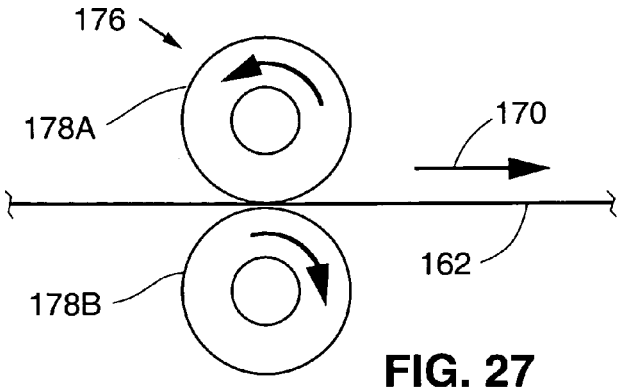
FIG. 27 is a schematic illustration of a sheet compressing station suitable for compressing the edge of a split sheet in accordance with one embodiment of the present invention.
Figure 28:
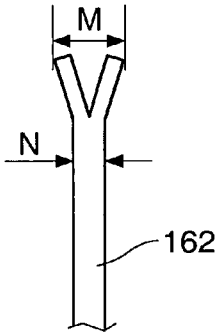
FIG. 28 shows an edge of a paper web after conditioning, with N representing the preconditioning thickness and M representing the thickness (somewhat exaggerated) after conditioning where the compressing step has not completely compressed the edge back to the original thickness N.

Once the web edge has been split as previously described, the web is further conditioned at a sheet compressing station 176 as shown in FIG. 27. The compressing station operates to compress the conditioned edge of the sheet by passing at least the sheet edge between a pair of pinch rollers 178A and 178B. Since the amount of compressing force and the duration of the compressing force have been found to be interrelated, the preferred manner of quantifying the amount of compression needed is best specified in terms of the result. Whereas the amount of compression needed for a stack was previously said to be related to a reduction in the amount in the expansion produced in the first conditioning step, when individual sheets are being conditioned it is preferred that the ratio of the sheet thickness prior to conditioning to the thickness of the edge after compression be limited. Referring to FIG. 28, a sheet 162 is shown having a preconditioning thickness of N, which can be measured by simply measuring the sheet thickness in regions away from the sheet edge. Once the sheet edge has been condition, including being compressed, an edge having thickness M results, with the size of M being somewhat exaggerated in FIG. 28 for purposes of clarification. Preferably, the amount of compression is adequate if the ratio of the edge thickness after conditioning to the thickness prior to conditioning (M/N) is less than 1.3.

Figure 29:
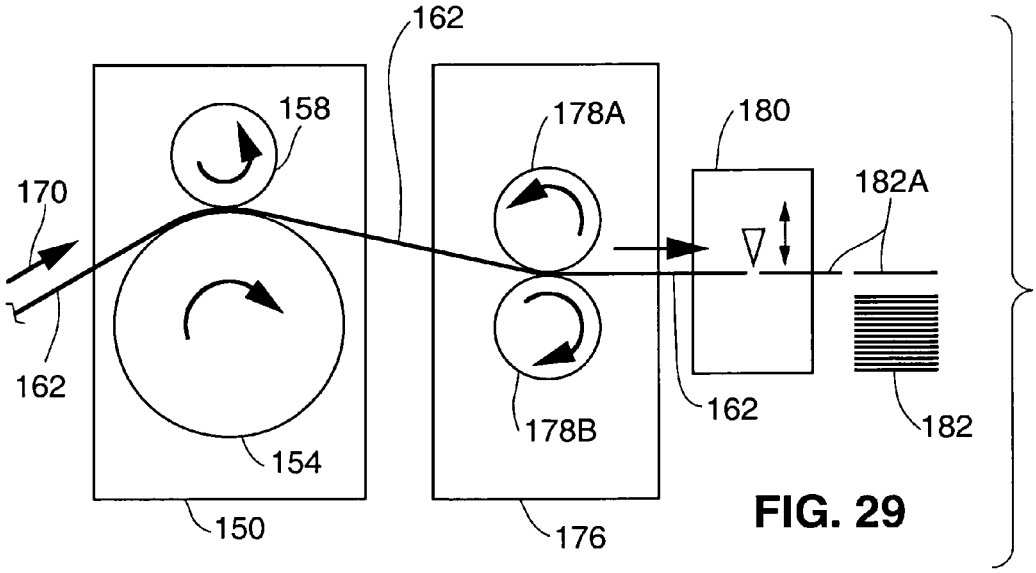
FIG. 29 is a schematic illustration of a sheet splitting station, which is fed by a continuous web of paper, followed by a sheet compressing station which is, in turn, followed by a paper cutting station which cuts the conditioned web into individual sheets of paper.

After the paper web 162 has been completely conditioned as described herein, the web is cut into individual paper sheets and then packaged for sale. FIG. 29 shows a preferred manufacturing arrangement where a continuous paper web 162 is first subjected to the splitting/cutting operation at station 150 followed by a the compressing operation at station 176. This is then followed by a cutting operation at station 180 where the continuous web is cut into individual sheets 182A which are formed into stacks 182 for packaging.

Thus, apparatus and related methods have been disclosed which permit stacks of essentially any paper type to be bound using thermally activated binder strips. Also, apparatus and related methods have been disclosed for conditioning individual sheets for binding along with the conditioned sheets themselves. Although preferred embodiments have been described in some detail, it is to be understood that certain changes can be made by those skilled in the art without departing from the spirit and scope of the invention as defined by the appended claims.

The invention claimed is:

1. A method of conditioning a sheet of paper for subsequent binding, said method comprising:

splitting the edge of the sheet, with said splitting resulting in an expansion of a thickness of the sheet, with the sheet edge being split for at least 25 percent of the length of the sheet; and subsequent to the splitting, compressing the edge of the sheet so that a ratio of a sheet edge thickness after compressing to the thickness of the sheet edge prior to the cutting is less than 1.3 and wherein the splitting includes passing the sheet over a first rotating roller while applying a cutting member to the sheet edge, with said first roller being positioned relative to the sheet edge such that one of the sheet split ends is disposed intermediate the first roller and a portion of the cutting member so that said first roller provides support to the sheet edge during the splitting.

2. A method of conditioning an edge of a sheet of paper for subsequent binding, with said sheet of paper having a coating that substantially reduces adhesion characteristics of thermal adhesive binder strips and wherein the sheet is disposed in a paper web together with other sheets, said method comprising:

conditioning an edge of the paper sheet in a manner so as to substantially enhance the adhesion characteristics of thermal adhesive binder strips, by passing the web through a conditioning apparatus;

compressing the conditioned edge by passing the web through a compressing apparatus; and passing the web from the compressing apparatus to a cutting apparatus where the sheet is cut from the web.

* * * * *